US008292384B2

(12) United States Patent
Fujii

(10) Patent No.: US 8,292,384 B2
(45) Date of Patent: Oct. 23, 2012

(54) LIQUID DROPLET EJECTION DEVICE

(75) Inventor: Masahiko Fujii, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 441 days.

(21) Appl. No.: 12/548,588

(22) Filed: Aug. 27, 2009

(65) Prior Publication Data

US 2010/0188450 A1 Jul. 29, 2010

(30) Foreign Application Priority Data

Jan. 29, 2009 (JP) ..... 2009-018479

(51) Int. Cl.
*B41J 29/38* (2006.01)

(52) U.S. Cl. ..... 347/5; 347/9; 347/15

(58) Field of Classification Search ..... 347/5, 9, 347/10–15, 19
See application file for complete search history.

(56) References Cited

U.S. PATENT DOCUMENTS 5,208,605 A * 5/1993 Drake ..... 347/15
6,811,238 B2 * 11/2004 Shingyohuchi ..... 347/11

FOREIGN PATENT DOCUMENTS

| | | |
|---|---|---|
| JP | 2002-337318 | 11/2002 |
| JP | 2003-94656 | 4/2003 |
| JP | 2003-118122 | 4/2003 |
| JP | 2004-202803 | 7/2004 |
| JP | 2004-243574 | 9/2004 |
| JP | 2005-007660 | 1/2005 |
| JP | 2005-238574 | 9/2005 |
| JP | 2007-144787 | 6/2007 |

* cited by examiner

*Primary Examiner* — Lam S Nguyen
(74) *Attorney, Agent, or Firm* — Fildes & Outland, P.C.

(57) ABSTRACT

A liquid droplet ejection device includes a recording section, a moving section, and a driving signal supplying section. In the recording section, plural liquid droplet ejectors are arrayed, each liquid droplet ejector has a driving element, and ejects a liquid droplet onto a recording medium in response to a driving signal being supplied to the driving element. The moving section moves the recording section and the recording medium relative to one another in a direction intersecting the array direction of the liquid droplet ejectors. The driving signal supplying section generates, when plural types of liquid droplets having different droplet volumes are ejected onto the recording medium while the recording section and the recording medium are moved relatively, the driving signals such that, the smaller a droplet volume of a liquid droplet, the faster the ejection speed of the liquid droplet.

11 Claims, 22 Drawing Sheets

FIG. 12

| | INITIAL SPEED | NOZZLE RADIUS (μm) | HEAT-GENERATING BODY SURFACE AREA (μm2) | INK CHAMBER HEIGHT (μm) | NOZZLE PLATE THICKNESS (μm) |
|---|---|---|---|---|---|
| LARGE DROP (3 pl) | 7m/s | 6 | 500 | 20 | 15 |
| SMALL DROP (0.9 pl) | 8.5m/s | 3 | 350 | 20 | 15 |
| COMPARATIVE EXAMPLE SMALL DROP (0.91 pl) | 7m/s | 3.5 | 300 | 20 | 15 |

PATTERN 1999

PATTERN 999

12
42
P
SIDE VIEW
12
42
P
42
FRONT VIEW 44
46
P
SIDE VIEW
44
12
46
P
44
46
FRONT VIEW

LIQUID DROPLET EJECTION DEVICE

CROSS-REFERENCE TO RELATED APPLICATION

This application is based on and claims priority under 35 USC 119 from Japanese Patent Application No. 2009-018479 filed on Jan. 29, 2009.

BACKGROUND

1. Technical Field

The present invention relates to a liquid droplet ejection device.

2. Related Art

There are known devices that have recording heads equipped with plural nozzles ejecting liquid droplets, and that eject liquid droplets onto a recording medium while relatively moving the recording heads and the recording medium.

SUMMARY

An aspect of the present invention is a liquid droplet ejecting device including: a recording section at which a plurality of liquid droplet ejectors are arrayed, each liquid droplet ejector having a driving element, and ejecting a liquid droplet onto a recording medium due to a driving signal for ejecting a liquid droplet being supplied to the driving element; a moving section that moves the recording section and the recording medium relative to one another in a direction intersecting an array direction in which the plurality of liquid droplet ejectors are arrayed; and a driving signal supplying section that, when a plurality of types of liquid droplets having different droplet volumes are ejected onto the recording medium while the recording section and the recording medium are moved relatively, generates the driving signals such that, the smaller a droplet volume of a liquid droplet, the faster the ejection speed of the liquid droplet, and supplies the driving signals to the driving elements.

BRIEF DESCRIPTION OF THE DRAWINGS

Exemplary embodiments of the present invention will be described in detail based on the following figures, wherein:

FIG. 12 is a table showing a design example of a recording head that ejects ink drops of different droplet volumes;

DETAILED DESCRIPTION

Hereinafter, exemplary embodiments will be described in detail with reference to the drawings.

First Exemplary Embodiment

Figure 1:
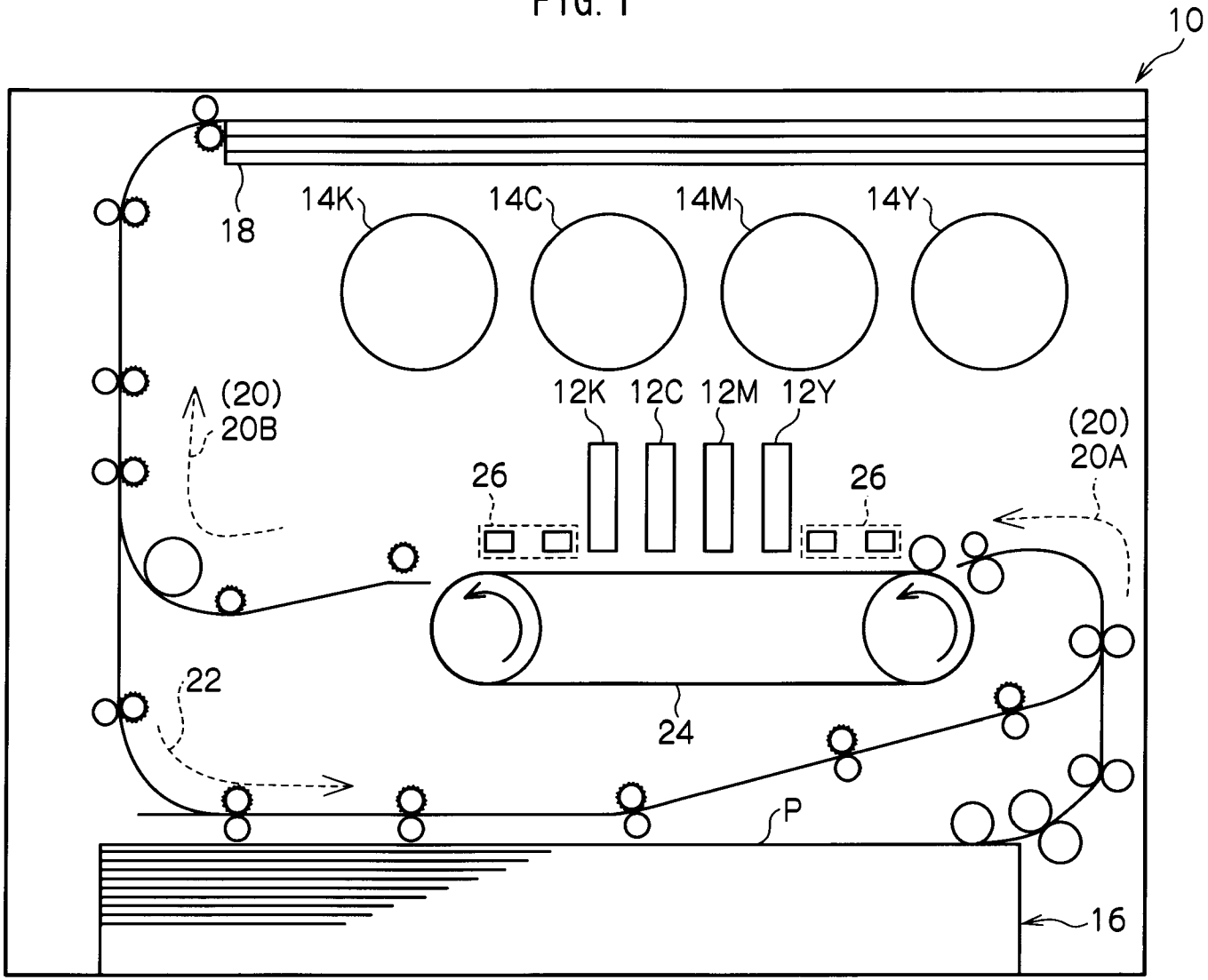
FIG. 1 is a schematic drawing showing the structure of a liquid droplet ejection device relating to exemplary embodiments.

As shown in FIG. 1, a liquid droplet ejection device 10 relating to the exemplary embodiment has recording heads 12Y through 12K of the respective colors of Y (yellow), M (magenta), C (cyan), K (black) that are arrayed from the upstream side in the conveying direction of a sheet P, and ink tanks 14Y through 14K that house inks that are supplied to the recording heads 12Y through 12K of the respective colors. In the following description, when explanation is given without particularly distinguishing the recording heads 12Y through 12K of the respective colors and the ink tanks 14Y through 14K, the letter at the end of the reference number will be omitted, and they will be called the recording head 12 and the ink tank 14.

The liquid droplet ejection device 10 has a sheet feeding section 16 that houses the sheets P that serve as recording media, a conveyer 24 that is formed as an endless belt and is disposed so as to oppose the recording heads 12 and conveys the sheet P, a sheet discharging section 18 that discharges the sheet P after printing, and a maintenance unit 26 that cleans the nozzles of the recording heads 12.

Further, plural conveying rollers are provided at the liquid droplet ejection device 10 such that a first conveying path 20 and a second conveying path 22 are formed. The first conveying path 20 is structured by a path 20A, that is from the sheet feeding section 16 to the conveyer 24, and a path 20B, that is from the conveyer 24 to the sheet discharging section 18. The second conveying path 22 is from the path 20B of the first conveying path to the conveyer 24 in the opposite direction (returns to the upstream side of the conveyer 24).

At the path 20A of the first conveying path 20, the sheets P are conveyed one-by-one from the sheet feeding section 16 by plural conveying rollers to the conveyer 24. At the path 20B, the sheet P arrives at the sheet discharging section 18 due to plural conveying rollers. In the exemplary embodiment, the second conveying path 22 is provided for double-sided printing.

The conveyer 24 has a belt that is trained around two rollers. Attractive force based upon the supply of electricity is used as the method of holding the sheet P by the conveyer 24. Namely, the sheet P is pressed against the belt by a charging roller, charges are provided to the sheet P, and attractive force is generated.

Figure 2:
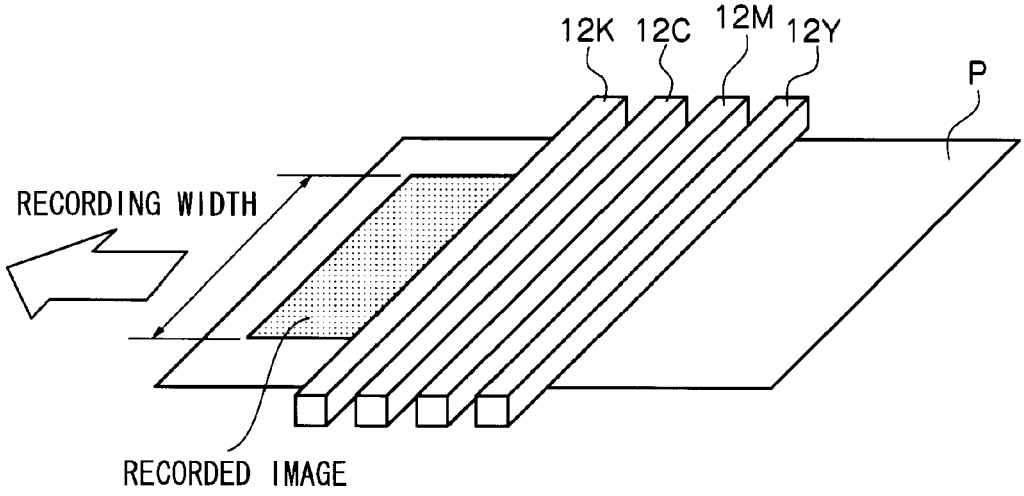
FIG. 2 is a perspective view showing the positional relationship between recording heads and a sheet P.

As shown in FIG. 2, the recording heads 12 of the respective colors have lengths substantially corresponding to the width of the sheet P that serves as the recording medium, and are disposed at predetermined intervals. Plural nozzles 2 (see FIG. 3 as well), that eject liquid droplets (ink drops in the exemplary embodiments), are arrayed at the recording head 12 along a direction intersecting the conveying direction of the sheet P. At the liquid droplet ejection device 10, an image is recorded on the sheet P by ejecting ink drops from the nozzles 2 while conveying the sheet P with the recording heads 12 fixed.

Figure 3:
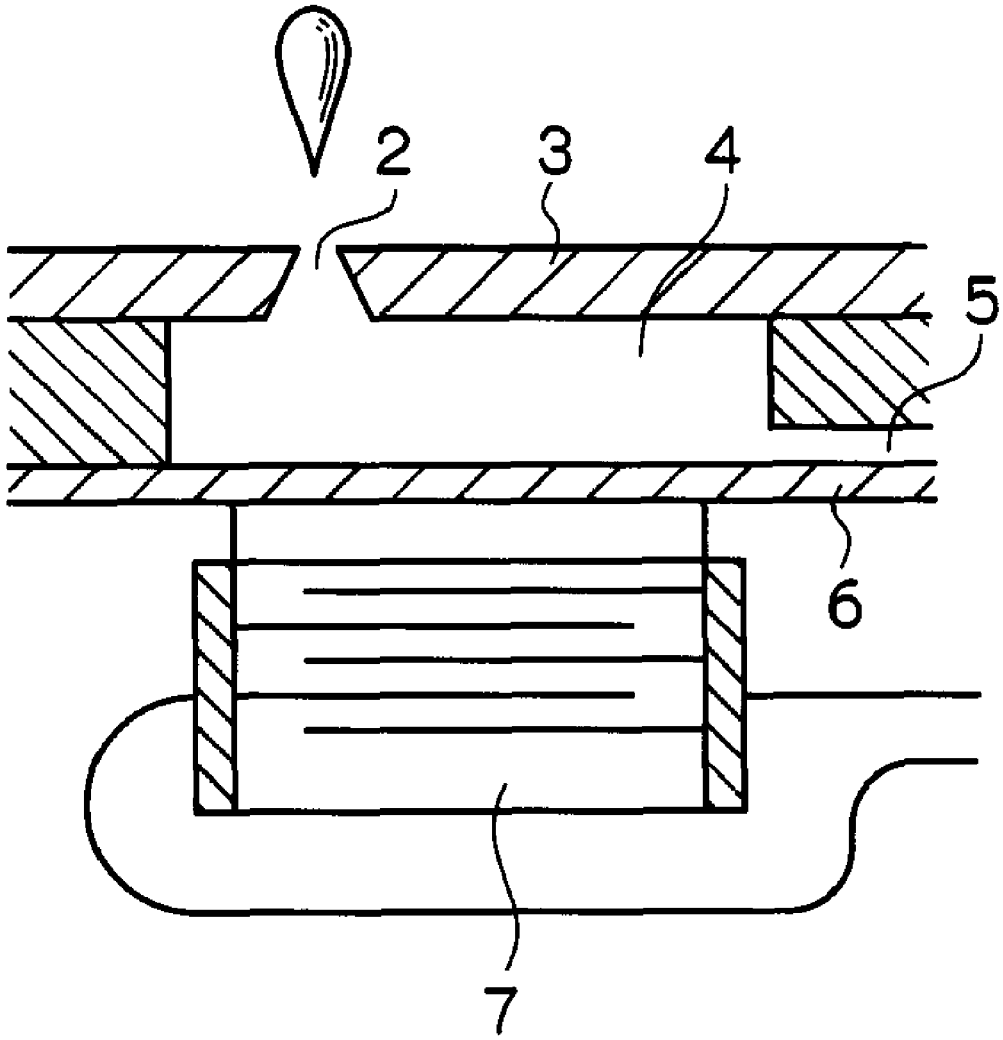
FIG. 3 is a cross-sectional view for explanation of the structure of the recording head.

FIG. 3 is a cross-sectional view for explanation of the structure of the recording head 12 at which the nozzles 2 are formed. The recording head 12 has a nozzle plate 3 in which the plural nozzles 2 are formed at a predetermined interval, pressure generating chambers 4 that are provided so as to correspond to the respective nozzles 2 and in which is filled ink that is to be ejected from the nozzles 2, ink supply paths 5 that supply ink from the ink tank 14 to the pressure generating chambers 4, vibrating plates 6 that are provided so as to correspond to the respective pressure generating chambers 4 and form respective one surfaces of the pressure generating chambers 4, and driving elements 7 provided so as to correspond to the respective vibrating plates 6. The driving element 7 of the exemplary embodiment is a piezo element. When a driving signal is applied to the driving element 7, the driving element 7 vibrates and the vibrating plate 6 vibrates, and the pressure generating chamber 4 expands or contracts. Due to the volume of the pressure generating chamber 4 changing (the pressure changing) due to this expansion/contraction, the ink filled within is ejected from the nozzle 2.

Note that, for example, the droplet amount (volume) and the ejection speed of the ink drop that is ejected from the nozzle 2 are controlled by controlling the waveform of the driving signal that is applied to the driving element 7.

Figure 4:
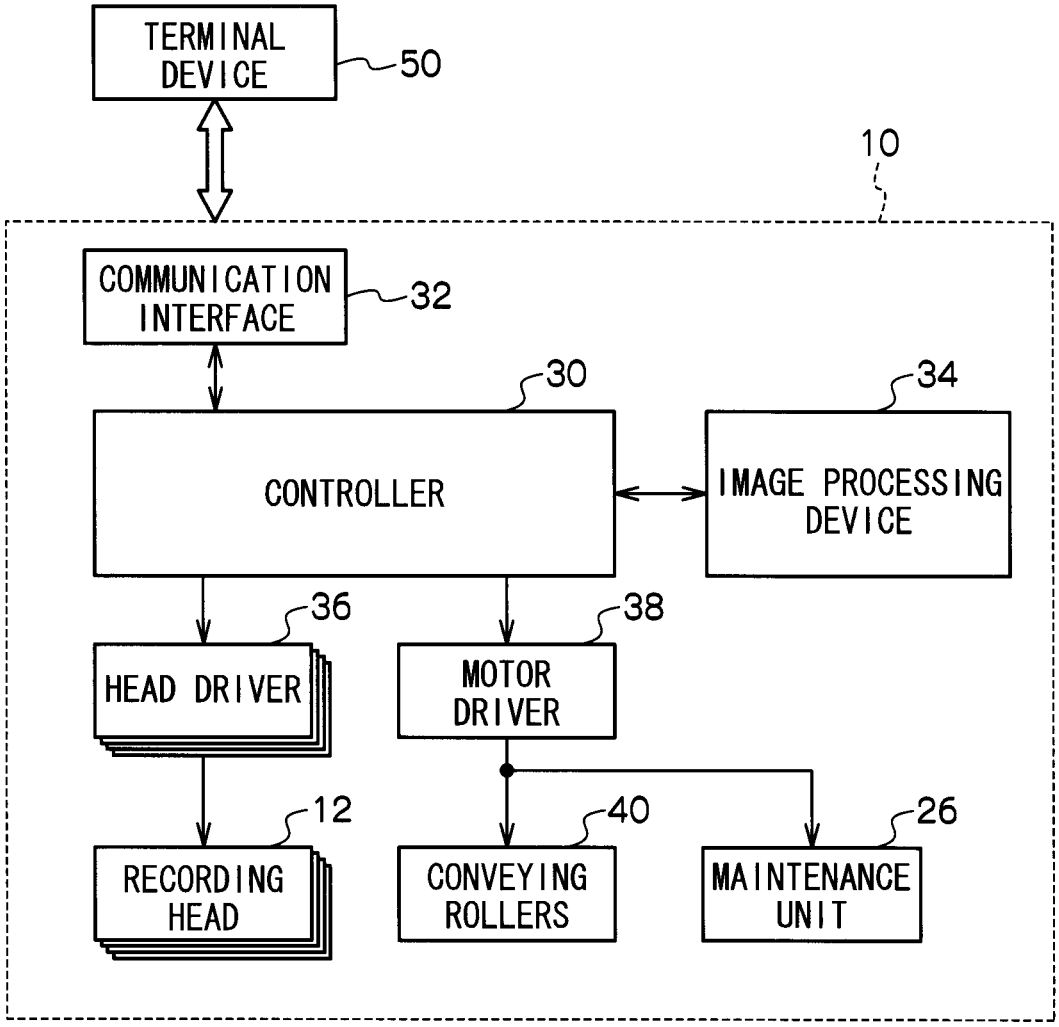
FIG. 4 is a block diagram showing the electrical structure of the liquid droplet ejection device.

FIG. 4 is a block diagram showing the electrical structure of the liquid droplet ejection device 10. The liquid droplet ejection device 10 is equipped with a controller 30 having a Central Processing Unit (CPU), a Read Only Memory (ROM) and a Random Access Memory (RAM). The CPU of the controller 30 controls the operations of the liquid droplet ejection device 10 by executing programs that are stored in the ROM.

A communication interface 32 for receiving image information (data) from an external terminal device 50, an image processing device 34 that carries out image processings such as halftone processing on received image data, head drivers 36 that drive the respective recording heads 12, and a motor driver 38 that drives conveying rollers 40 for conveying the sheet P (the conveying rollers 40 for forming the above-described first conveying path 20 and second conveying path 22) and drives the maintenance unit 26, are connected to the controller 30.

When image data is received at the communication interface 32 of the liquid droplet ejection device 10, the received image data is sent-out to the image processing device 34 via the controller 30, and halftone processing is carried out thereon at the image processing device 34. For example, when recording is carried out at the liquid droplet ejection device 10 in the two gradations of "no drop/large drop", halftone processing that converts the image data into binary gradation values expressing "no drop/large drop" is carried out. When recording in the four gradations of "no drop/small drop/medium drop/large drop" is carried out, halftone processing is carried out that converts the image data into quaternary gradation values expressing "no drop/small drop/medium drop/large drop". In the exemplary embodiments, the halftone processing is carried out by known error diffusion processing or dither processing.

In accordance with the gradations of the image data that is obtained by the halftone processing, the controller 30 generates selection signals for selecting driving signals to be applied to the driving elements 7 corresponding to the respective nozzles 2 of the respective recording heads 12. On the basis of the selection signals generated at the controller 30, the head drivers 36 select the driving signals to be applied to the respective driving elements 7 of the recording heads 12, and supply the driving signals to the driving elements 7. In the exemplary embodiment, information (data) of plural types of driving waveforms are stored in advance in an unillustrated storage section, and the head drivers 36 generate the driving signals on the basis of the stored data of the plural types of driving signals. For each of the driving elements, the head drivers 36 select the driving signal in accordance with the selection signal received from the controller 30, and supply the driving signal to the driving element 7. Ink drops are thereby ejected from the nozzles 2.

In the exemplary embodiment, when recording an image onto the sheet P by ejecting ink drops of different droplet volumes, the driving signals are generated and are supplied to the driving elements 7 such that, the smaller the droplet volume of an ink drop, the faster the ejection speed. Not only the droplet volume of the ink drop, but the ejection speed as well is determined by the waveform of the driving signal that is supplied to the driving element 7. What waveform to supply for each of the droplet volumes is set on the basis of results of experimentation or the like that is carried out in advance. In the exemplary embodiment, the initial speed of the ink drop is adjusted as the ejection speed. For example, an average speed, that is computed on the basis of the time period from the time that the distal end of the ink drop appears from the nozzle 2 to the time that the distal end of that ink drop reaches a predetermined distance from the nozzle 2, serves as the initial speed.

Here, the relationship between the ejection speed and the landing position of an ink drop will be described.

When recording an image on the sheet P while moving the recording heads 12 and the sheet P relatively, airflow is generated in the direction of relative movement due to the relative movement. The majority of this airflow can be explained with a known flowing state that is called a Couette flow. The faster the relative moving speed between the recording heads 12 and the sheet P, the greater the effects of this airflow. When this airflow is generated, the effects of the airflow in the relative moving direction on ink drops of a small droplet volume (small ink drops) is greater than the effects on ink drops of a large droplet volume (large ink drops) (i.e., at the small ink drops, the decrease in speed due to air resistance becomes greater and the distance that the ink drops are veered off-course by the air becomes greater). Further, because the decrease in speed due to air resistance differs by the size of ink drops, the distance that the sheet moves until the ink drops land on the sheet differs. Accordingly, if driving signals are supplied such that the initial speeds of the small ink drops and the large ink drops are the same, there are cases in which dots that are formed by the large ink drops and the small ink drops are not formed at the same positions on the sheet in the relative moving direction. As image quality improves, the ejected ink droplet volume becomes more minute, and, as demands for high-speed printing also increase, the relative moving speed of the recording heads 12 and the sheet P becomes faster. Accordingly, the situation is that the effects of airflow cannot be ignored.

The effects of airflow will be described hereinafter by using the drawings. Note that, in the liquid droplet ejection device 10, the recording heads 12 and the sheet P are moved relatively with the recording heads 12 being fixed and the sheet P being conveyed. Therefore, explanation will be given with the relative moving direction being called the sheet moving direction, and the relative moving speed being called the sheet moving speed.

Further, although the liquid droplet ejection device 10 of the exemplary embodiment has the four recording heads 12Y through 12K of Y, M, C, K, hereinafter, description will focus on one of the recording heads 12 among these four recording heads 12.

Figure 5A:
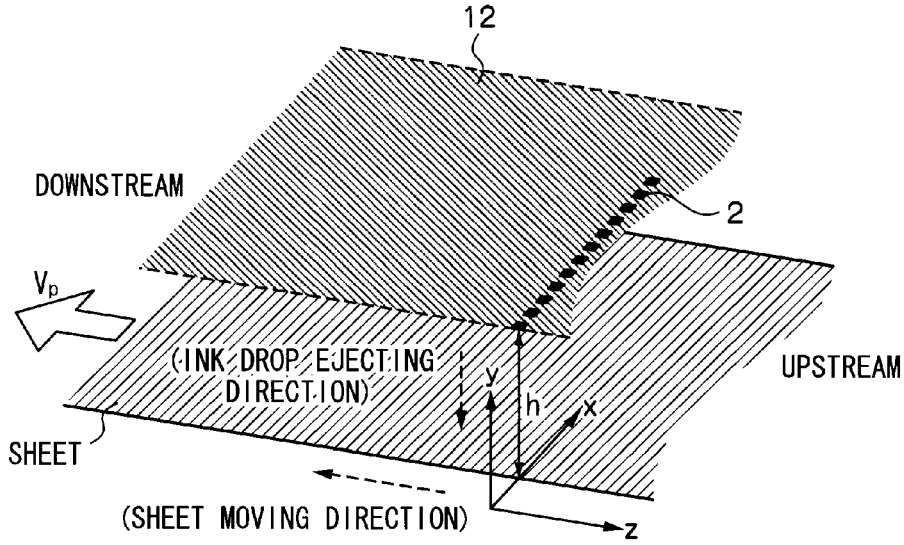
FIG. 5A is a drawing for explanation of a model for computing a flying locus of an ink drop.

FIG. 5A is a drawing for explanation of a model for calculating the flying locus of an ink drop. Here, a three-dimensional coordinate system of x, y, z is used. The direction in which the nozzles of the recording head 12 are lined-up is the x-axis, the direction in which the ink drops are ejected from the recording head 12 onto the sheet P is the y-axis, and the sheet conveying direction (the sheet moving direction) is the z-axis direction. The graphs shown in FIG. 6 through FIG. 9B show the results of simulation using the model shown in FIG. 5A.

Figure 6:
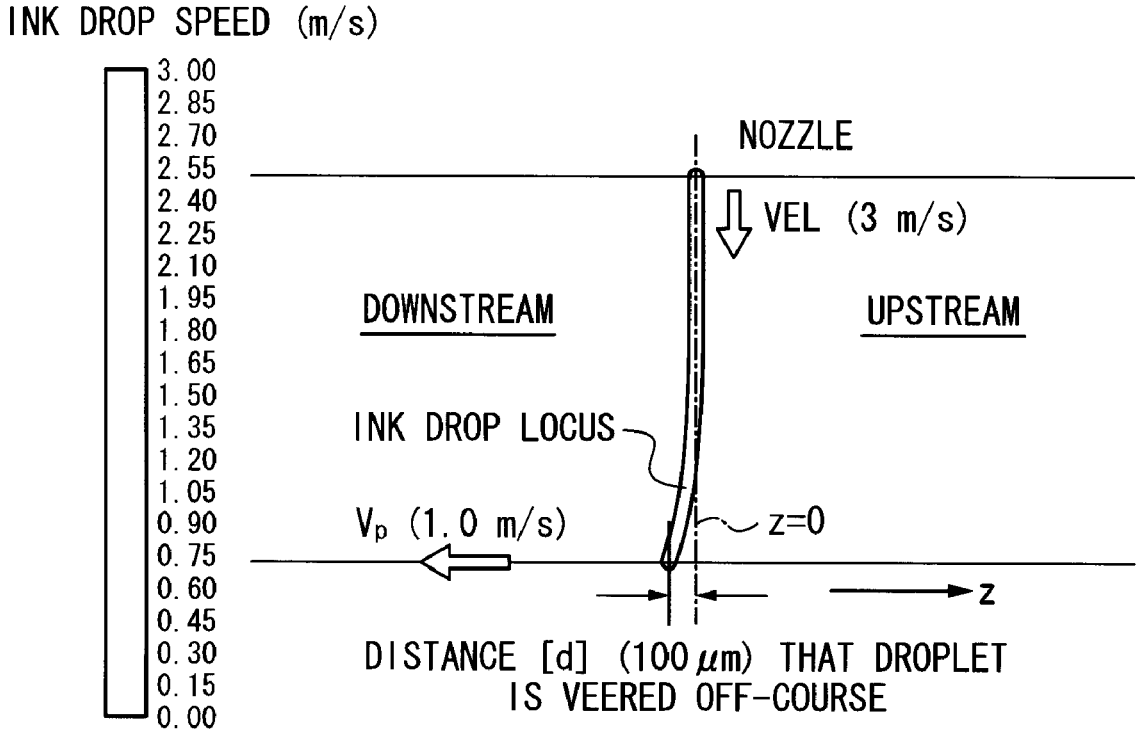
FIG. 6 is a graph showing an example of changes in the flying locus and speed of an ink drop.

FIG. 6 is a graph showing an example of the flying locus of an ink drop and changes in speed. Illustrated is the flying locus of an ink drop when a sheet moving speed Vp is 1 m/s and an ink drop of 3.05 pl (picoliters) is ejected at an initial speed VEL of 3 m/s. In the example shown in FIG. 6, the initial speed of the ink drop is 3 m/s, but immediately before the ink drop lands on the sheet P, the speed has fallen to 0.8 m/s. As is clear from FIG. 6, because a decrease in speed in the ejecting direction (the y direction) arises due to air resistance, the time until an ink drop reaches the sheet P is longer than the time that is calculated from the distance and the initial speed. Further, because the ink drop is veered off-course by the airflow generated in the sheet moving direction, the landing position is offset by d (here, 100 μm) downstream in the sheet moving direction (the z direction). The landing position offset amount differs in accordance with the initial speed and the droplet volume of the ink drop, and further, also differs in accordance with the (relative) sheet moving speed between the recording head 12 and the sheet P.

Figure 7A:
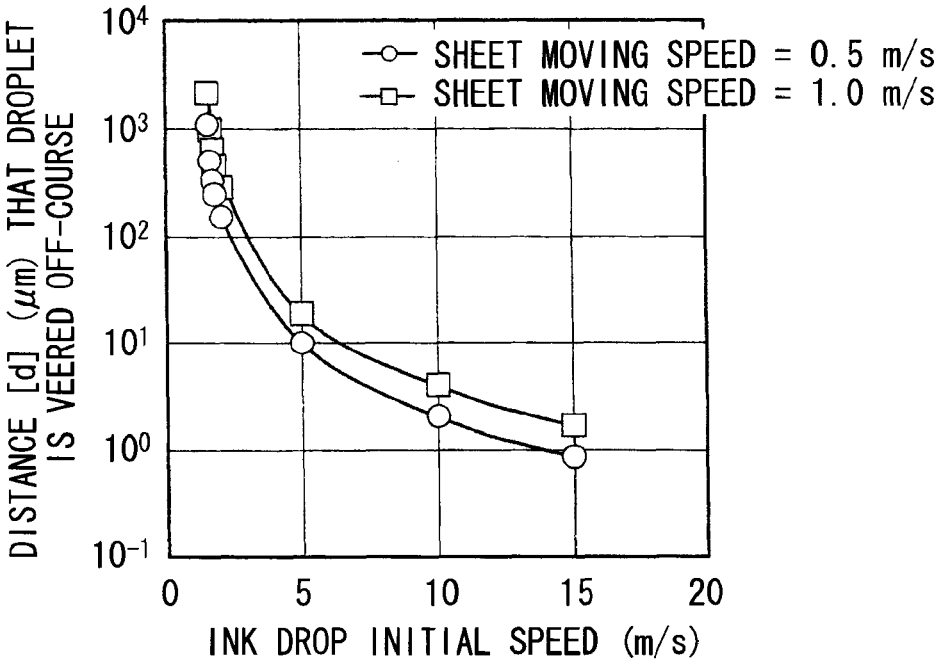
FIG. 7A is a graph showing examples of the distance that an ink drop of 3.05 pl is veered off-course in a z direction by airflow.
Figure 7B:
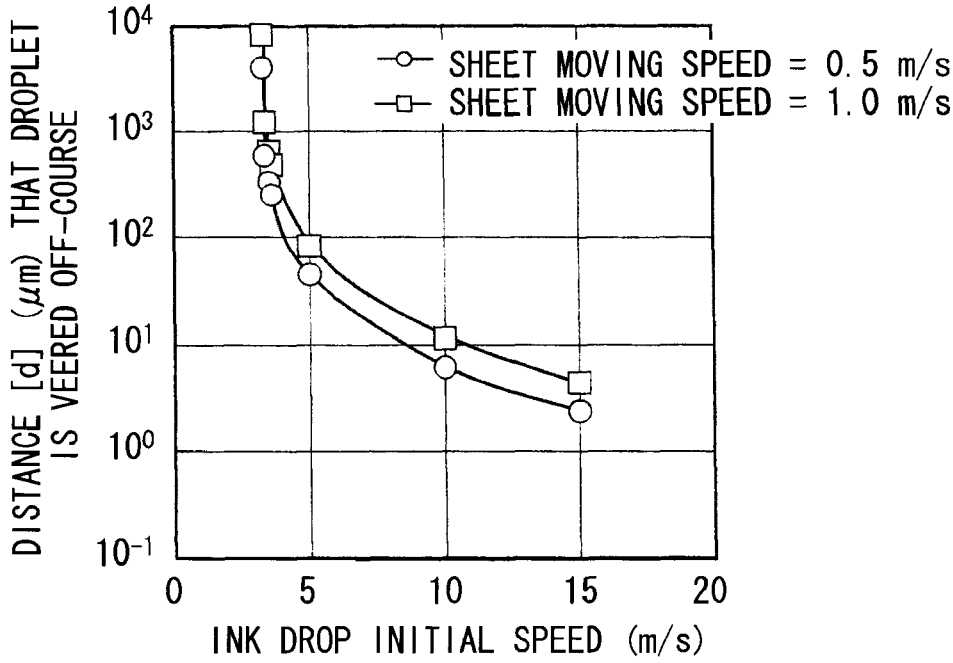
FIG. 7B is a graph showing examples of the distance that an ink drop of 0.91 pl is veered off-course in the z direction by airflow.

FIG. 7A is a graph showing an example of the distance that an ink drop of 3.05 pl is veered off-course in the z direction by airflow, and FIG. 7B is a graph showing an example of the distance that an ink drop of 0.91 pl is veered off-course in the z direction by airflow.

As shown in FIG. 7A and FIG. 7B, for both of the ink drops, the higher the initial speed, the shorter the distance d that the ink drop is veered off-course in the z direction, and further, the slower the sheet moving speed, the shorter the distance d that the ink drop is veered off-course in the z direction. Moreover, under the same conditions, the distance d over which the ink drop is veered off-course is longer for the smaller drop than the larger drop.

Figure 8:
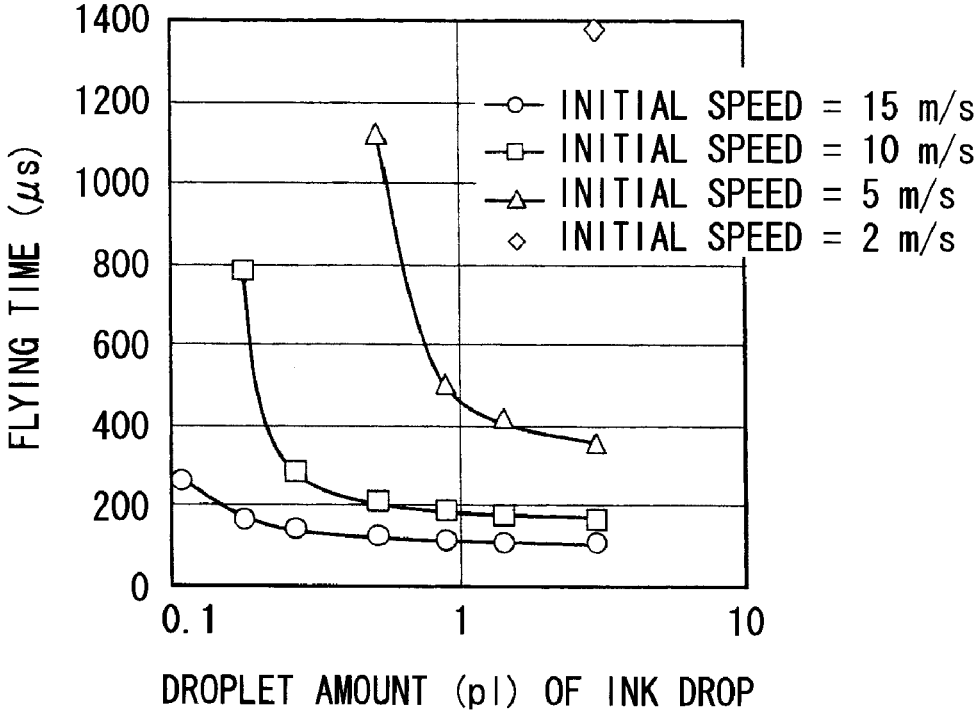
FIG. 8 is a graph showing examples of the time period that an ink drop flies from a nozzle to the sheet P, in accordance with the droplet amount (volume) and the initial speed of the ink drop that is ejected.

FIG. 8 is a graph showing, in accordance with the droplet volume and the initial speed of the ejected ink drop, examples of the time period that an ink drop flies from the nozzle 2 to the sheet P. As is clear from FIG. 8, the faster the initial speed or the larger the droplet volume of the ink drop, the shorter the flying time period. Accordingly, the distance that the sheet P moves until the ink drop lands on the sheet P is shorter.

Figure 9A:
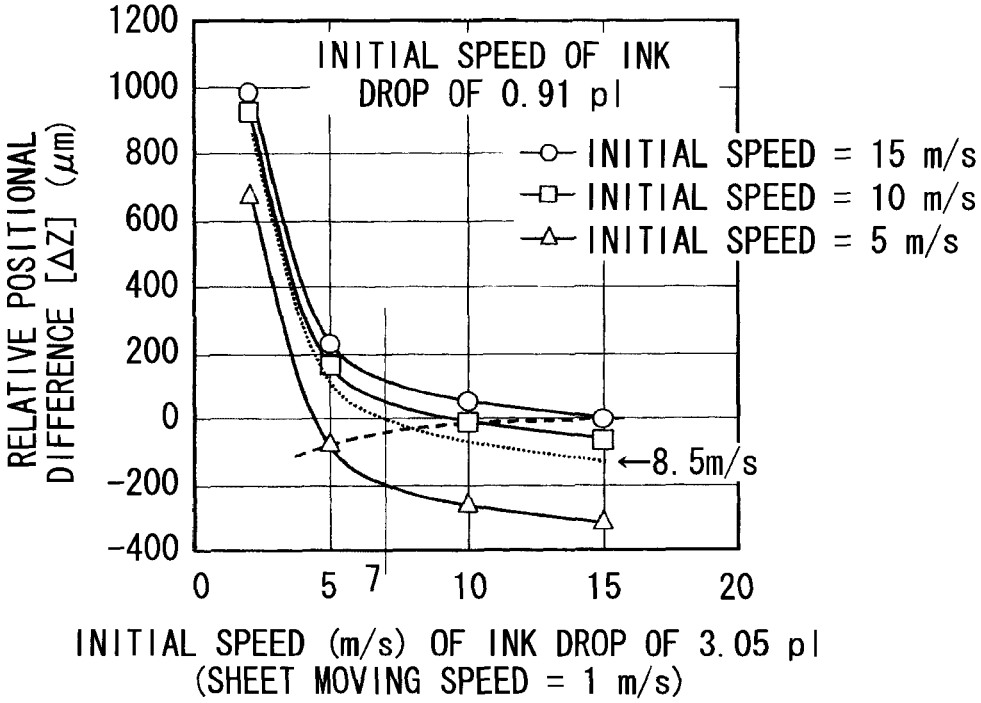
FIG. 9A is a graph showing, per initial speed, examples of relative positional differences in a sheet moving direction between a dot that is formed on a sheet by an ink drop of 3.05 pl and a dot that is formed on the sheet by an ink drop of 0.91 pl when the sheet moving speed is 1 m/s.

FIG. 9A is a graph showing, per initial speed, examples of relative positional differences in the sheet moving direction between a dot that is formed on a sheet by an ink drop of 3.05 pl and a dot that is formed on the sheet by an ink drop of 0.91 pl when the sheet moving speed is 1 m/s. Here, a relative positional difference ΔZ when the dot formed by the ink drop of 0.91 pl is formed at the sheet moving direction downstream side of the dot formed by the ink drop of 3.05 pl is given a "+" sign. Conversely, the relative positional difference ΔZ when the dot formed by the ink drop of 0.91 pl is formed at the sheet moving direction upstream side of the dot formed by the ink drop of 3.05 pl is given a "−" sign.

As described above, the effects of air resistance differ in accordance with the size of the ink drop. Therefore, at the same initial speed, the time period from ejecting to reaching the sheet differs for the drop of 3.05 pl and the drop of 0.91 pl, and the distance that the sheet moves until the ink drop reaches the sheet differs. Further, the distance that the ink drop is veered off-course due to the airflow that is generated in the sheet conveying direction also differs.

Thus, for example, in order to form a dot formed by an ink drop of 0.91 pl at substantially the same position on the sheet as a dot that is formed when an ink drop of 3.05 pl is ejected at an initial speed of 7 m/s, in the example shown in FIG. 9A, it suffices to eject the ink drop of 0.91 pl at an initial speed of around 8.5 m/s that is faster than that of the ink drop of 3.05 pl.

If both the ink drop of 3.05 pl and the ink drop of 0.91 pl are ejected at an initial speed of 15 m/s, dots can be formed at substantially the same position. However, it is known that, if the initial speed is made to be too fast, it is easy for mist (small drops like dust that arise by separating from the ink drop that is ejected from the nozzle 2) to form.

Figure 9B:
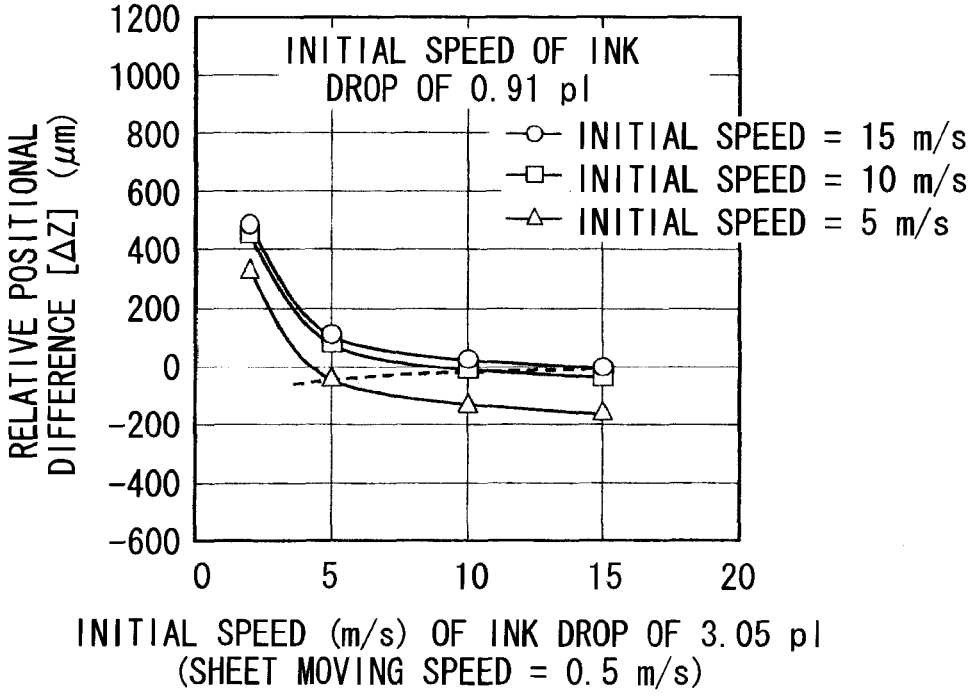
FIG. 9B is the same graph when the sheet moving speed is 0.5 m/s.

FIG. 9B is a graph showing, per initial speed, examples of relative positional differences in the sheet moving direction between a dot that is formed on a sheet by an ink drop of 3.05 pl and a dot that is formed on the sheet by an ink drop of 0.91 pl when the sheet moving speed is 0.5 m/s. As is clear from FIG. 9A and FIG. 9B, even when the initial speed and the droplet volume of the ink drop are the same conditions, the faster the sheet moving speed, the greater the relative positional difference $\Delta Z$. Thus, the initial speed (the driving signal that is used) is set in advance in accordance with the sheet moving speed of the liquid droplet ejection device and the droplet volume of the ink drop that is ejected.

Figure 10A:
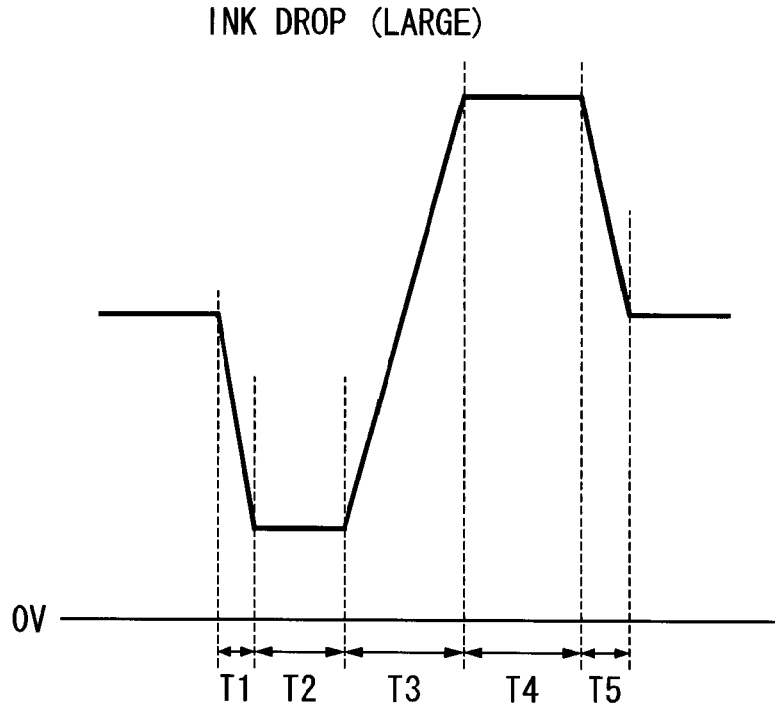
FIG. 10A is a drawing showing an example of a waveform of a driving signal for ejecting an ink drop of a given droplet volume.
Figure 10B:
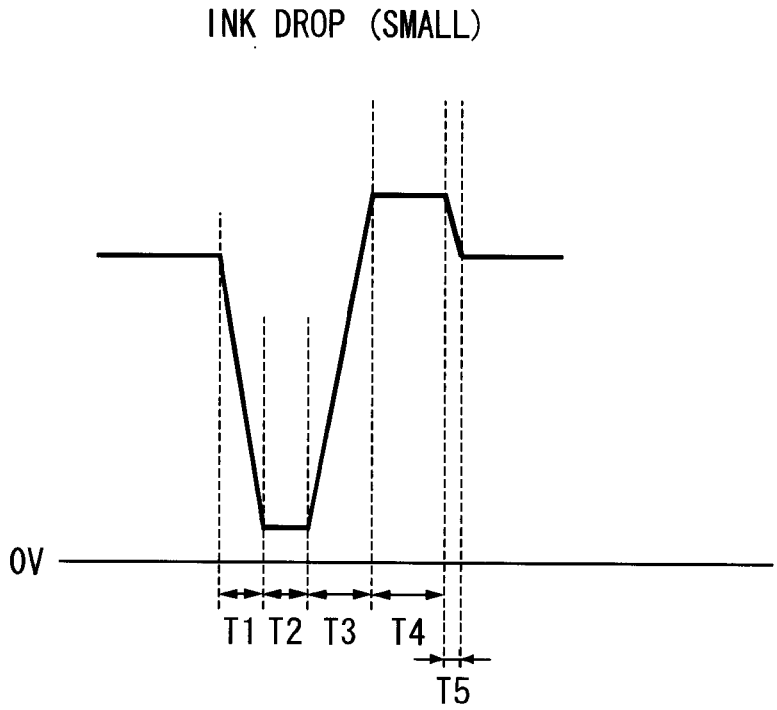
FIG. 10B is a drawing showing an example of a waveform of a driving signal for ejecting an ink drop of a droplet volume that is less than in FIG. 10A.

FIG. 10A is a drawing showing an example of a waveform (hereinafter, a "large drop waveform") of a driving signal for ejecting an ink drop of a given droplet volume. FIG. 10B is a drawing showing an example of a waveform (hereinafter, a "small drop waveform") of a driving signal for ejecting an ink drop of a droplet volume that is less than in FIG. 10A. Here, explanation will be given by using a basic pull-push-pull waveform as an example.

As shown in FIG. 10A and FIG. 10B, the waveforms of the respective driving signals are structured by the following partial waveforms.

Time Period T1: a pull waveform (the driving element 7 is deformed so as to cause the pressure generating chamber 4 to expand from the static state)

Time Period T2: a holding waveform (the expanded state of the pressure generating chamber 4 due to the deformation of the driving element 7, is maintained)

Time Period T3: a push waveform (the driving element 7 is deformed so as to cause the pressure generating chamber 4 to contract)

Time Period T4: a holding waveform (the contracted state of the pressure generating chamber 4 due to the deformation of the driving element 7, is maintained)

Time Period T5: a pull waveform (the driving element 7 is deformed so as to cause the pressure generating chamber 4 to expand and to return the pressure within the pressure generating chamber 4 to the original static state)

In the first exemplary embodiment, as shown in FIG. 10A and FIG. 10B, the small drop waveform is generated by making the pull waveform of time period T1 larger than that of the large drop waveform, and the voltage level of the holding waveform of time period T4 smaller than that of the large drop waveform. Further, the slope of the push waveform of time period T3 of the small drop waveform is made to be large. By making the slope of the push waveform of time period T3 large, the initial speed of the ink drop that is ejected becomes faster.

Note that the waveforms of the driving signals, that control the droplet volumes and the ejection speeds of the ink drops, are not only those that are illustrated here. By changing the wave heights, the holding time periods or the slopes, the droplet volumes and the ejection speeds can be adjusted.

Further, here, description is given by using a small drop waveform and a large drop waveform as examples. However, the number of types of droplet volumes is not limited to two. For example, also when there are three or more types (e.g., a small drop, a medium drop, a large drop, or the like), in the same way as described above, driving signals can be generated and supplied such that the ejection speeds (initial speeds) are made to differ, and, the smaller the droplet volume of an ink drop, the faster the initial speed thereof.

In the first exemplary embodiment, the recording head 12, at which a piezo element is provided as a driving element for each nozzle, is described. However, the exemplary embodiment is not limited to the same, and, for example, a recording head, in which a heat-generating element is provided as a driving element for each nozzle, may be employed.

Hereinafter, a structural example when employing a structure that ejects ink drops by using heat-generating elements at the recording head of the liquid droplet ejection device 10, will be described by using FIG. 11A through FIG. 11C and FIG. 12.

Figure 11A:
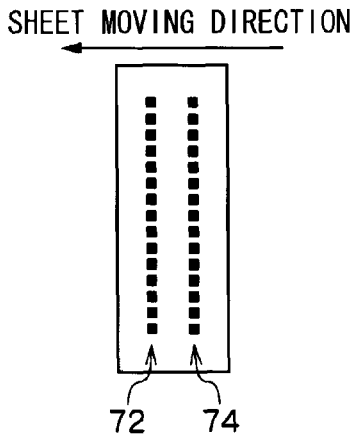
FIG. 11A is a drawing showing an example of an arrayed state of nozzles that are arrayed at the recording head.
Figure 11B:
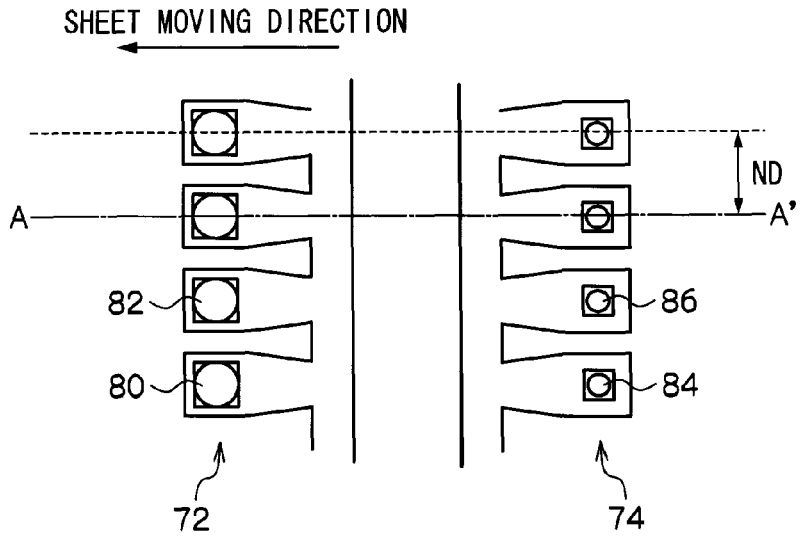
FIG. 11B is a top view for explanation of an example of the structure of the recording head.
Figure 11C:
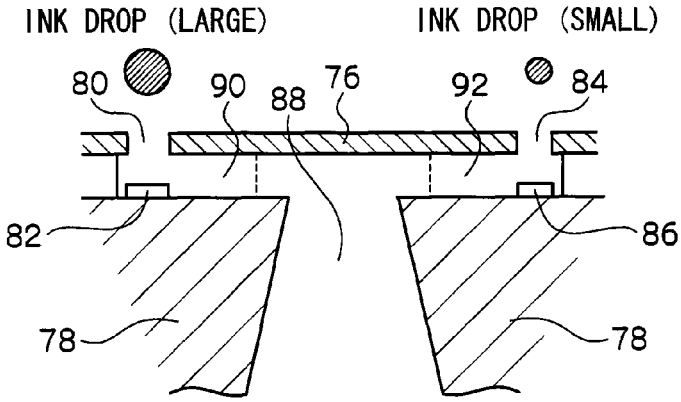
FIG. 11C is a drawing showing an example of a cross-section along A-A' of FIG. 11B.

FIG. 11A is a drawing showing an example of an arrayed state of nozzles that are arrayed at a recording head 70. FIG. 11B is a top view for explanation of an example of the structure of the recording head 70. FIG. 11C is a drawing showing an example of a cross-section along line A-A' of FIG. 11B.

As shown in FIG. 11A, two nozzle rows, in which plural nozzles are arrayed in a direction intersecting the sheet moving direction, are formed at the recording head 70. One of the nozzle rows is a large drop nozzle row 72 at which are arrayed nozzles that eject ink drops of large droplet volumes (hereinafter, "large drops"). The other nozzle row is a small drop nozzle row 74 at which are arrayed nozzles that eject ink drops of smaller droplet volumes than the large drops (hereinafter, "small drops").

As shown in FIG. 11B, the large drop nozzle row 72 is structured such that plural nozzles 80 having heat-generators 82 respectively are arrayed at interval ND. Further, the small drop nozzle row 74 is structured such that plural nozzles 84, that have heat-generators 86 that are smaller-sized than the heat-generator 82 and whose opening portion size is smaller than that of the nozzles 80 for the large drops, are arrayed at the interval ND.

As shown in FIG. 11C, the recording head 70 has a nozzle plate 76, in which the nozzles 80 for the large drops and the nozzles 84 for the small drops are formed at predetermined intervals, and a heat-generator substrate 78. The heat-generators 82 are provided at the heat-generator substrate 78 in correspondence with the nozzles 80 for the large drops, and the heat-generators 86 are provided at the heat-generator substrate 78 in correspondence with the nozzles 84 for the small drops. Ink is supplied from the ink tank 14 via ink supply paths 88 to ink chambers 90 for the large drops, that are connected to the nozzles 80 for the large drops, and to ink chambers 92 for the small drops, that are connected to the nozzles 84 for the small drops.

At the recording head 70 that is structured in this way, the ink drops are ejected as follows. When image data is received, as described above, image processings such as halftone processing and the like are carried out at the image processing device 34 and for example, image data having gradation values of "no drop/large drop/small drop" is generated. The controller 30 transmits control signals such that driving signals corresponding to the image data are supplied to the heat-generators 82, 86 corresponding to the respective nozzles 80, 84. When the head drivers 36 receive these control signals, the head drivers 36 apply the driving signals to the heat-generators 82, 86. Due to these driving signals, the heat-generators 82, 86 are energized and generate heat. The ink on the heat-generators 82, 86 causes boiling such that bubbles are generated, the ink within the respective ink flow paths is pressurized, and ink drops are ejected from the nozzles 80, 84.

Note that the ejection speed (here, the initial speed) of the small drops is designed in advance so as to be faster than the initial speed of the large drops. A design example is shown in FIG. 12.

The nozzle 80 for the large drop, that ejects an ink drop of 3 pl, is formed such that the nozzle radius thereof is 6 μm. The heat-generator 82, that corresponds to the nozzle 80 for the large drop, is formed such that the surface area thereof is 500 $\mu m^2$.

On the other hand, the nozzle 84 for the small drop, that ejects an ink drop of 0.9 pl, is formed such that the nozzle radius thereof is 3 μm. The heat-generator 86, that corresponds to the nozzle 84 for the small drop, is formed such that the surface area thereof is 350 $\mu m^2$.

The heights of the ink chamber 90 for the large drop and the ink chamber 92 for the small drop are both 20 μm, and the plate thickness of the nozzle plate 76 is 15 μm.

By forming the recording head 70 in this way, the initial speed of the large drops is 7 m/s, whereas the initial speed of the small drops is 8.5 m/s.

Note that, as a comparative example, a design example when designing such that the initial speed of the small drops and the initial speed of the large drops are both the same at 7 m/s, is also shown in FIG. 12 in the bottom row.

Second Exemplary Embodiment

The first exemplary embodiment describes an example of a liquid droplet ejection device that suppresses the landing position offset between ink drops of different droplet volumes. The second exemplary embodiment focuses on the point that the effects of airflow differ in accordance with the nozzle position, and describes, as an example, a liquid droplet ejection device that suppresses landing position offset that arises due thereto.

Note that the liquid droplet ejection device, that is described in the second exemplary embodiment, is a device of the same structure as the liquid droplet ejection device 10 described by using FIG. 1 through FIG. 4 of the first exemplary embodiment, and therefore, description of the structure is omitted. Further, in the second exemplary embodiment as well, explanation will be given by focusing on one recording head 12 among the four recording heads 12 of the liquid droplet ejection device 10. Moreover, although the nozzles were given the reference number 2 in the first exemplary embodiment, the reference numbers to the nozzles are omitted in the second exemplary embodiment.

When recording an image having a width that is greater than or equal to a given length in the nozzle array direction by a large number of nozzles (and in particular, an image of a high image density), the ink drops that are ejected from, among the nozzles that record the image, the nozzles that are positioned at the both ends in the nozzle array direction and within predetermined ranges from the both ends (hereinafter called "both end regions") are veered off-course by a greater distance in the sheet moving direction than ink drops that are ejected from nozzles other than the nozzles positioned at the both end regions. This is because airflow collides with the ink drop bunch that is ejected in succession, and airflow arises also in a direction (the nozzle array direction) intersecting the sheet moving direction, and, at the both end regions, flows of air that go around the nozzle array direction outer sides are formed. Further, because airflow is generated in the nozzle array direction as well, the landing positions become offset not only in the sheet moving direction, but in the nozzle array direction as well.

Figure 13A:
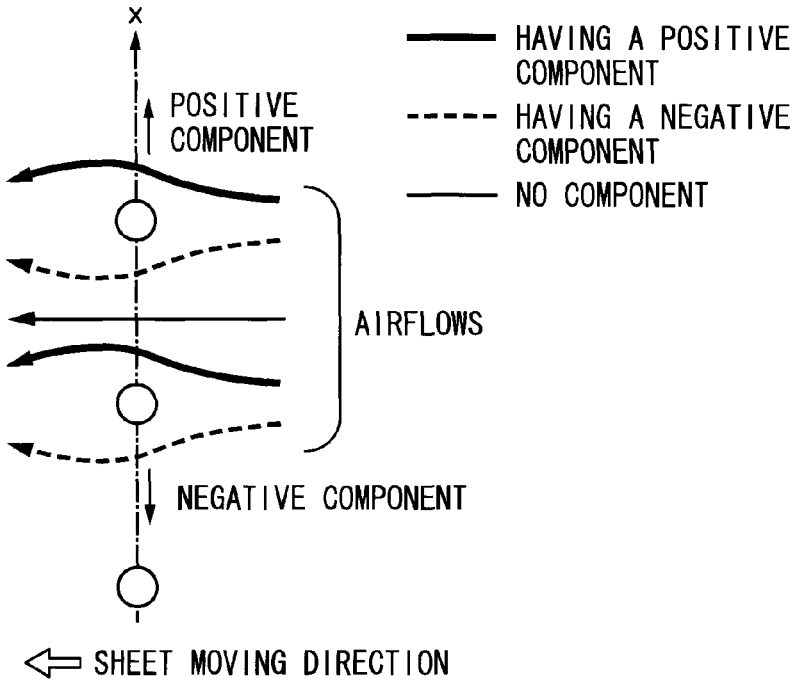
FIG. 13A is an explanatory drawing for explaining the state of airflows when the recording head and the sheet P are moved relatively and ink drops are ejected in succession by nozzles that, among the plural nozzles that are arrayed adjacent to one another, are disposed apart by a plural number of nozzles in a nozzle array direction (x direction)

FIG. 13A is an explanatory drawing for explaining the state of airflow when the recording head 12 and the sheet P are moved relatively, and ink drops are ejected in succession at nozzles that, among the plural nozzles that are arrayed adjacent to one another, are disposed apart by a plural number of nozzles in the nozzle array direction (the x direction). Further, FIG. 13B is an explanatory drawing for explaining the state of airflow when the recording head 12 and the sheet P are moved relatively, and ink drops are ejected in succession from each of the plural nozzles that are arrayed adjacent to one another.

Figure 13B:
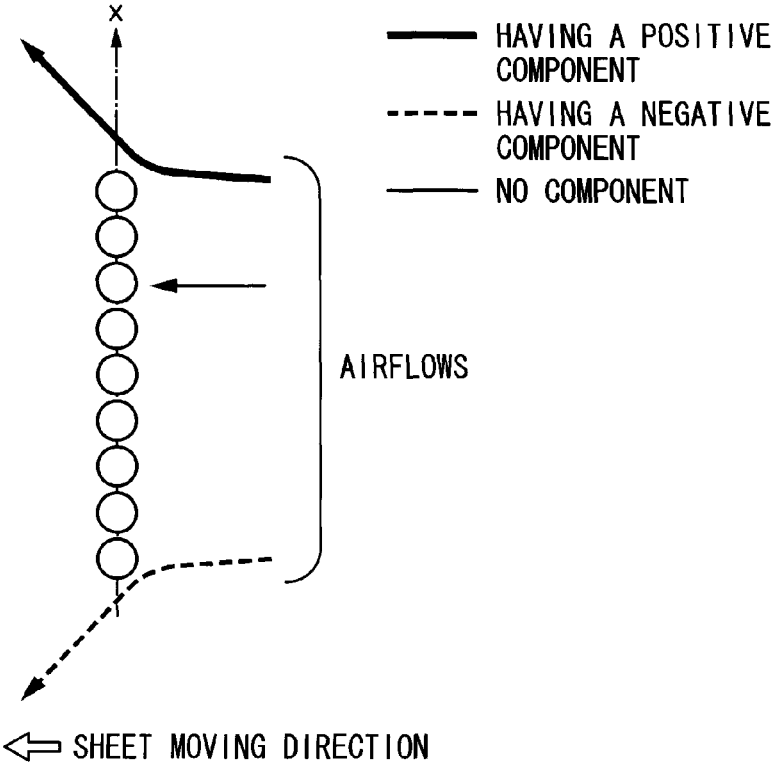
FIG. 13B is an explanatory drawing for explaining the state of airflows when the recording head and the sheet P are moved relatively and ink drops are ejected in succession from each of the plural nozzles that are arrayed adjacent to one another.
Figure 14A:
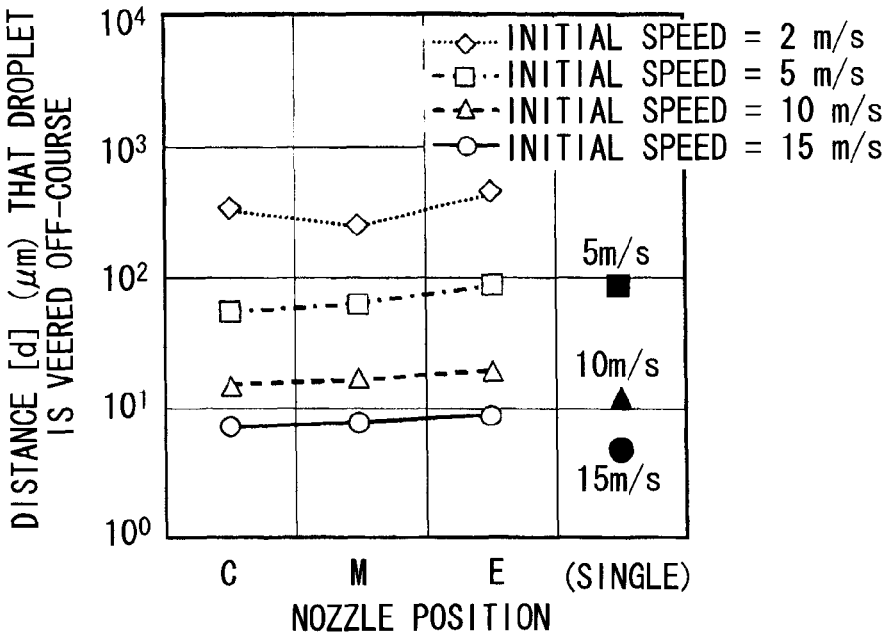
FIG. 14A through FIG. 14D are graphs showing examples of nozzle position dependency of the distance that an ink drop is veered off-course in the sheet moving direction (the z direction) in accordance with the initial speed of the ink drop, for each of four types of recording patterns.
Figure 14B:
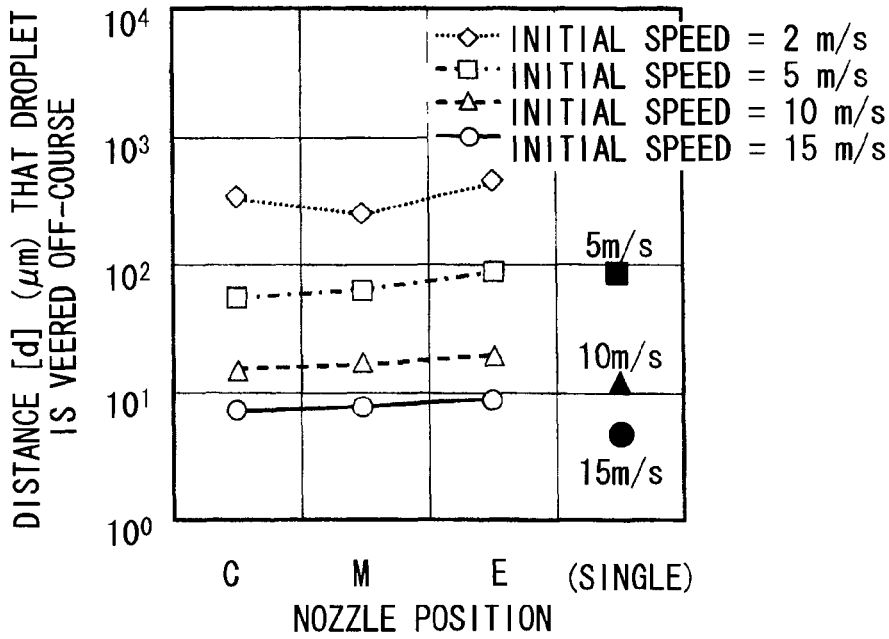
Figure 14C:
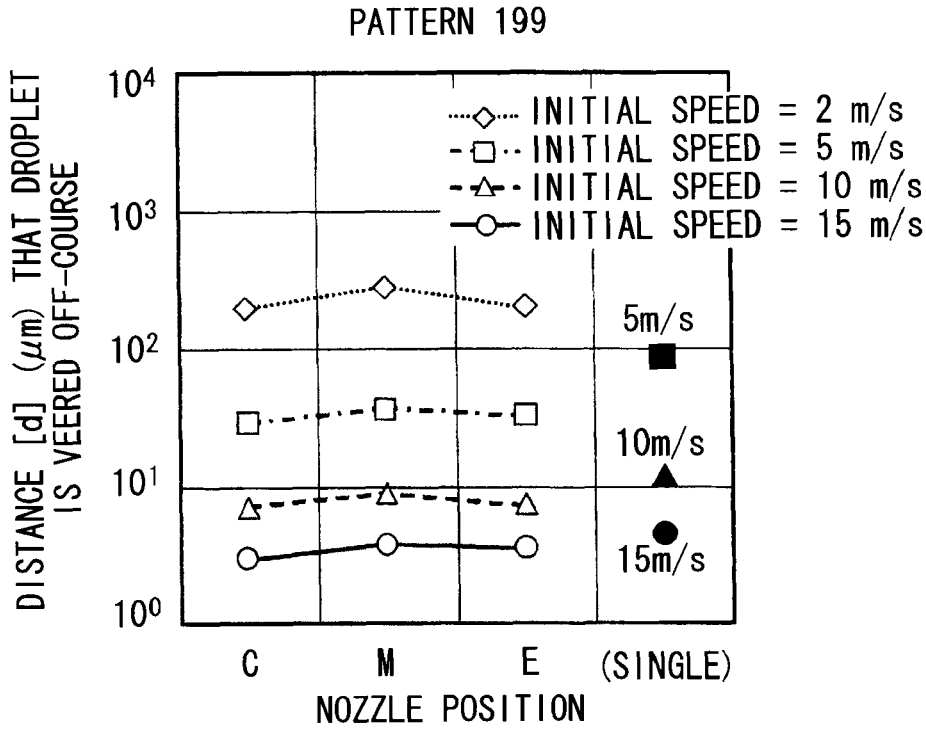
Figure 14D:
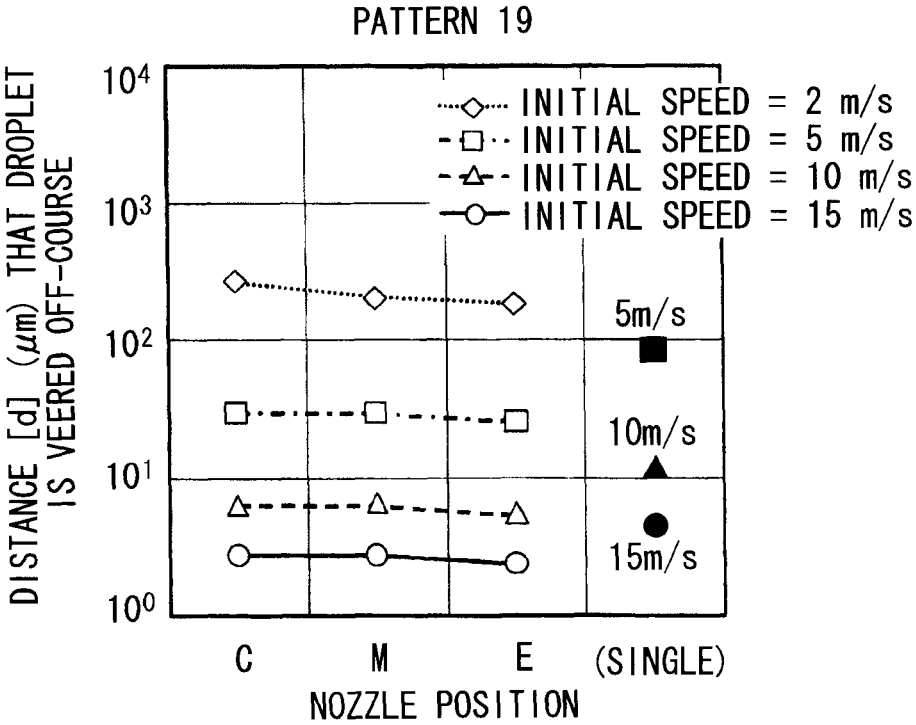

Note that, in FIG. 13A and FIG. 13B, given that the upper side along the x-axis is the positive direction and the lower side is the negative direction, airflow having a component in the positive direction (positive component) is shown by the thick arrow, airflow having a component in the negative direction (negative component) is shown by the thick dashed arrow, and airflow having both a positive component and a negative component is shown by the thinner arrow.

When ejecting of ink drops is carried out with the nozzles thinned-out (the interval between ink drops that are adjacent in the nozzle array direction is wide), air flows in the spaces at the peripheries of the nozzles that eject the ink drops (i.e., the spaces of the positions of the nozzles that do not eject ink drops). Therefore, airflows that pass through the positions of the nozzles that do not eject ink drops, such as shown in FIG. 13A, arise.

On the other hand, when ejecting of ink drops is carried out in succession from plural adjacent nozzles (the interval between ink drops that are adjacent in the nozzle array direction is narrower than that of FIG. 13A or is adjacent), first, in the initial stage of ejecting, airflow arises in the sheet moving direction (the z direction). Next, when the initial stage has passed, the airflow collides with the continuous ink drop bunch that is ejected from the nozzles positioned at the region other than the both end regions, and the z direction velocity component of the airflow decreases (the force veering the ink in the z direction decreases). Further, at this time, airflows of the both end regions go around the outer sides of the regions where there is no ink drop bunch, i.e., the both ends of the nozzle array, and therefore, airflows such as shown in FIG. 13B arise. Note that, due thereto, airflow also arises in the x direction.

Accordingly, when ink drops are ejected in succession from adjacent nozzles, the z direction velocity component of the ink drops, that are ejected from the nozzles of the both end regions of the nozzle array, becomes high, and it becomes easy for the ink drops to be veered off-course. Due thereto, the distance, that the ink drops that are ejected from the nozzles of the both end regions are veered off-course in the sheet moving direction, becomes large. Note that, as described above, at the both end regions, flow components of air arise toward the outer sides of the nozzle array that ejects the ink drops. Therefore, at the both end regions, there are cases in which the landing positions may become offset not only in the sheet moving direction, but also in the nozzle array direction.

Hereinafter, the airflows corresponding to the nozzle positions, and the distances that the ink drops are veered off-course by these airflows, will be described in further detail by using the drawings.

Figure 5B:
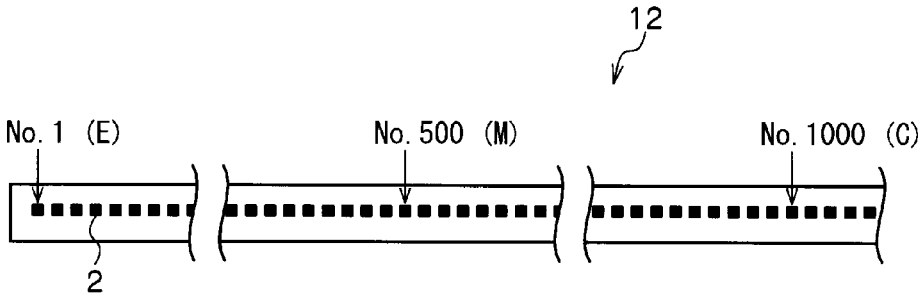
FIG. 5B is a drawing for explanation of a nozzle position model for computing the distance that an ink drop is veered off-course (swept) in accordance with the nozzle position.

FIG. 5B is a drawing for explanation of a nozzle position model for calculating the distances that ink drops are veered off-course in accordance with the nozzle positions. Here, an example is given of the recording head 12 in which 1999 nozzles from No. 1 to No. 1999 are arrayed in a direction intersecting the sheet moving direction. In FIG. 5B, "E" shows nozzle position No. 1 that is disposed at one of the both ends of the entire nozzle array, "C" shows nozzle position No. 1000 that is disposed at the center of the entire nozzle array, and "M" shows nozzle position No. 500 that is disposed at the center of the nozzle array from No. 1 to No. 1000. The graphs shown from FIG. 14A through FIG. 18B show the results of simulations by using the models shown in FIG. 5A and FIG. 5B. Note that, in all of these simulations, computation is carried out with the droplet volume of the ink drop being 0.9 pl and the sheet moving speed being 1 m/s.

FIG. 14A through FIG. 14D are graphs showing examples of nozzle position dependency of the distance that an ink drop is veered off-course in the sheet moving direction (the z direction) in accordance with the initial speed of the ink drop, for each of four types of recording patterns. The recording patterns of FIG. 14A through FIG. 14D are as follows.

A: a recording pattern that ejects ink drops in succession from all (1999) nozzles of the recording head 12

B: a recording pattern that ejects ink drops in succession from, among all of the nozzles of the recording head 12, the 999 nozzles that are spaced about two apart in the nozzle array direction C: a recording pattern that ejects ink drops in succession from, among all of the nozzles of the recording head 12, the 199 nozzles that are spaced about ten apart in the nozzle array direction D: a recording pattern that ejects ink drops in succession from, among all of the nozzles of the recording head 12, the 19 nozzles that are spaced about 100 apart in the nozzle array direction Namely, these are recording patterns whose ink drop ejection densities (pixel densities) decrease in the order of A, B, C, D.

Note that, hereinafter, the recording pattern of A will be called pattern 1999, the recording pattern of B will be called pattern 999, the recording pattern of C will be called pattern 199, and the recording pattern of D will be called pattern 19.

For reference, the distance that an ink drop is veered off-course in the sheet moving direction when an ink drop is ejected singly from one nozzle (Single), is shown at the right side of each graph.

As is clear from these graphs, in pattern 1999 (FIG. 14A), the ink drop that is ejected from the nozzle disposed at the end E of the nozzle array is veered off-course in the sheet moving direction by a long distance, as compared with the ink drops that are ejected from the nozzles positioned at C and M. Further, as the initial speed becomes slower, the dependency on the nozzle position increases, and further, the distance that the ink drop is veered off-course in the sheet moving direction also becomes longer. On the other hand, in the other recording patterns, the differences between the nozzle positions of C, M, E respectively in the sheet moving direction are small as compared with pattern 1999. However, as in the pattern 1999, the slower the initial speed, the longer the distance the ink drop is veered off-course.

Figure 15A:
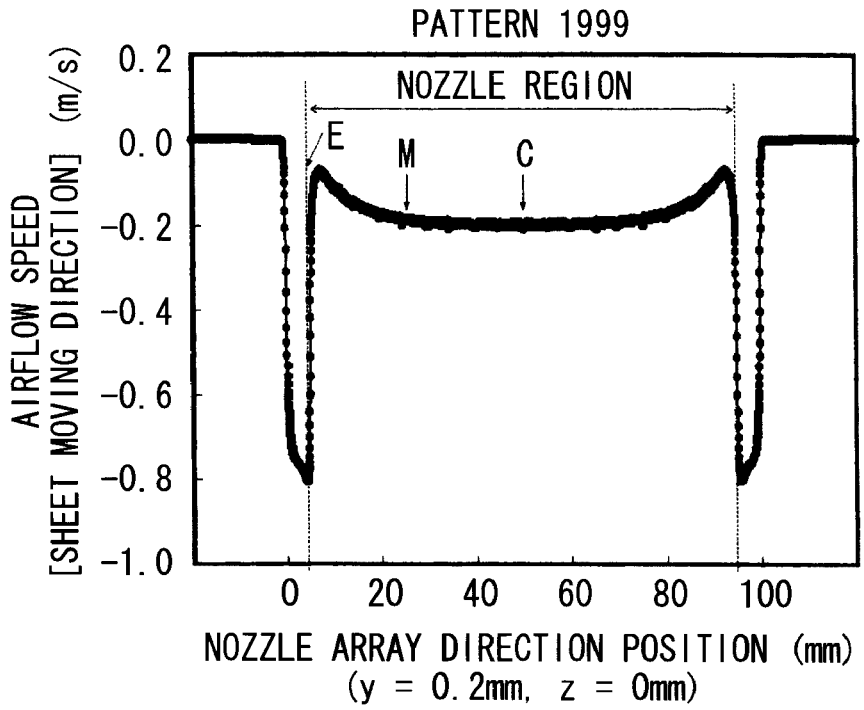
FIG. 15A is a graph showing an example of the relationship between nozzle position in the nozzle array direction and airflow speed in the sheet moving direction when ink drops are ejected in pattern 1999.
Figure 15B:
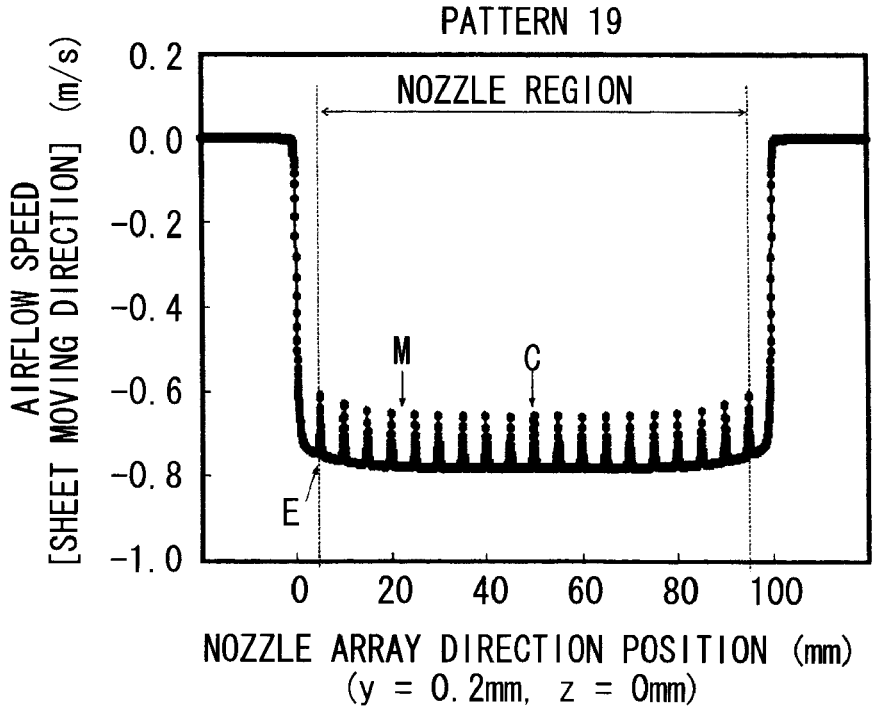
FIG. 15B is the same graph when ink drops are ejected in pattern 19.

FIG. 15A and FIG. 15B are graphs showing examples of the relationship between nozzle position in the nozzle array direction and airflow speed in the sheet moving direction. FIG. 15A is a graph when ink drops are ejected in pattern 1999, and FIG. 15B is a graph when ink drops are ejected in pattern 19.

In FIG. 15A, in a vicinity of the nozzle array end portion E, the airflow speed in the sheet moving direction becomes fast due to the airflow that goes around the outer side of the nozzle array. At other regions, airflow collides with the ink drop bunch and the airflow speed becomes slow.

On the other hand, in FIG. 15B, at the portions of the 19 nozzles that eject ink drops, airflow collides with the ejected ink drops and the airflow speed becomes slightly slower. However, at the peripheries of the nozzles that eject the ink drops, air passes through the spaces where ink drops are not ejected, and therefore, the state in which the airflow speed is fast is maintained. However, when viewed overall, the differences in airflow speeds in accordance with nozzle position are not greater than in the case of pattern 1999.

Figure 16:
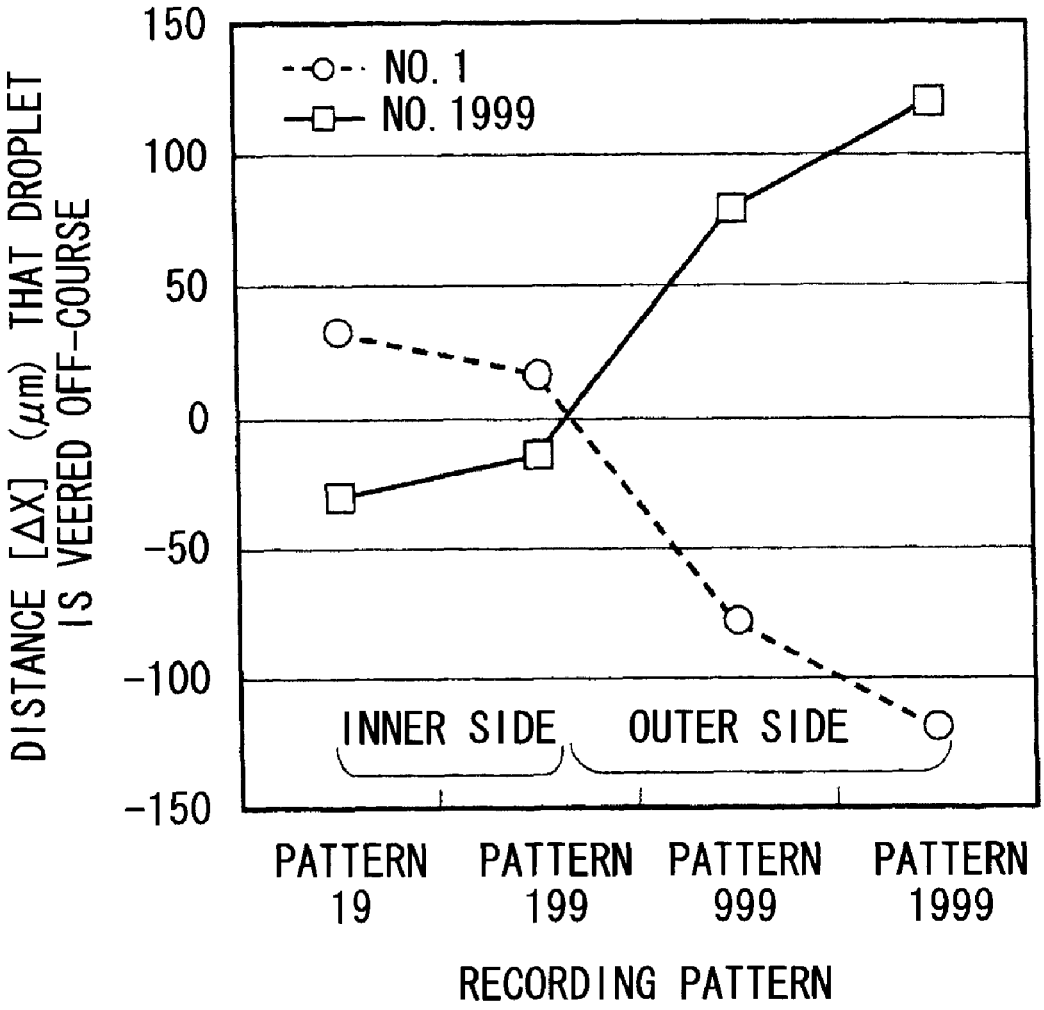
FIG. 16 is a graph showing examples of recording pattern dependency of the distance that ink drops, that are ejected from the nozzles positioned at the both ends in the nozzle array direction (No. 1 and No. 1999), are veered off-course in the nozzle array direction (the x direction) when the ink drops are ejected at an initial speed of 2 m/s.

FIG. 16 is a graph showing an example of recording pattern dependency of the distance that ink drops, that are ejected from the nozzles positioned at the both ends in the nozzle array direction (No. 1 and No. 1999), are veered off-course in the nozzle array direction (x direction) when the ink drops are ejected at an initial speed of 2 m/s. Referring to FIG. 5B, the direction from nozzle No. 1 toward No. 1999 is expressed as positive, and the direction from No. 1999 toward No. 1 is expressed as negative.

As is clear from this graph, in the cases of pattern 19 and pattern 199, the ink drops that are ejected from the nozzles at the both ends are veered off-course toward the inner side of the nozzle array region. This is because spaces are formed at the nozzle portions that do not eject ink drops, and air flows in these spaces. In this case, the inwardly-directed airflow becomes strong, and the landing positions of the ink drops of the both ends will offset toward the inner side of the nozzle array region.

On the other hand, in the cases of pattern 999 and pattern 1999, the ink drops that are ejected from the nozzles at the both ends are veered off-course toward the outer sides of the nozzle array region. This is because, as described above, flows that go around the ink drop bunch arise. In this case, the landing positions of the ink drops at the both ends will offset toward the outer sides of the nozzle array region.

Figure 17:
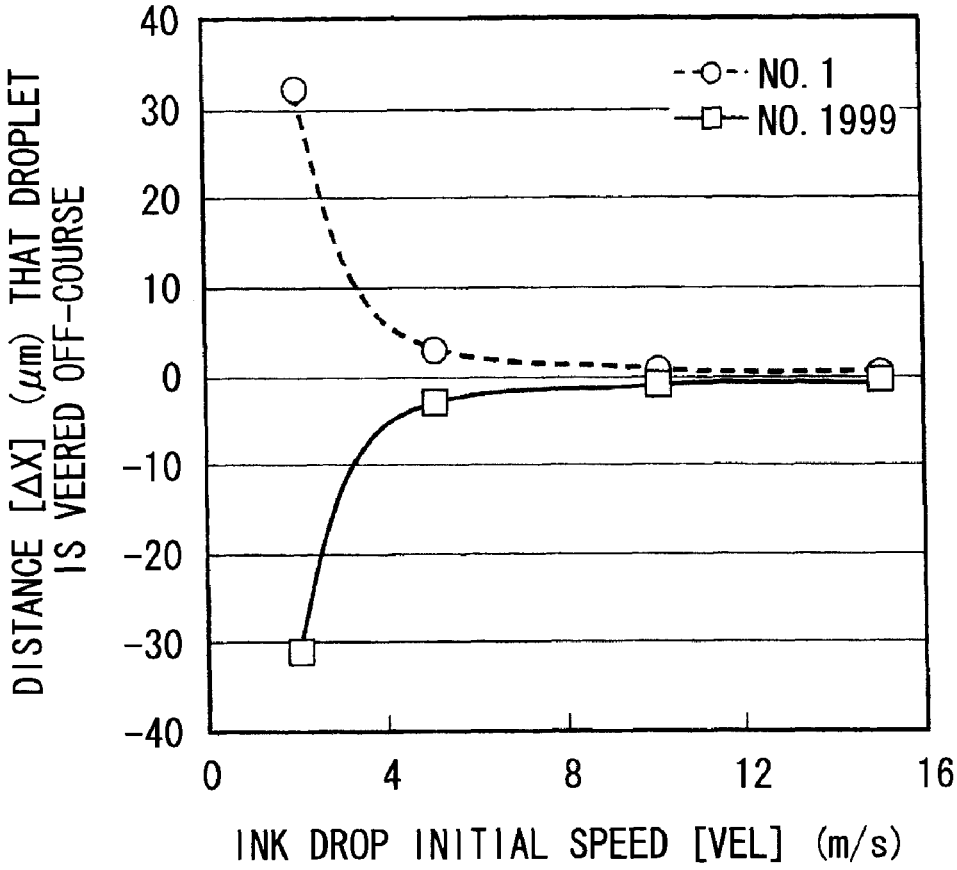
FIG. 17 is a graph showing examples of initial speed dependency of the distance that ink drops, that are ejected from the nozzles positioned at the both ends in the nozzle array direction (No. 1 and No. 1999), are veered off-course in the nozzle array direction when the ink drops are ejected in pattern 19.

FIG. 17 is a graph showing an example of initial speed dependency of the distance that ink drops, that are ejected from the nozzles positioned at the both ends in the nozzle array direction (No. 1 and No. 1999), are veered off-course in the nozzle array direction when the ink drops are ejected in pattern 19. As shown in FIG. 17, when the ink drop initial speed is made to be fast, the amount that is veered off-course in the nozzle array direction becomes small. Here, pattern 19 is given as an example, but the same holds for the other recording patterns as well.

Figure 18A:
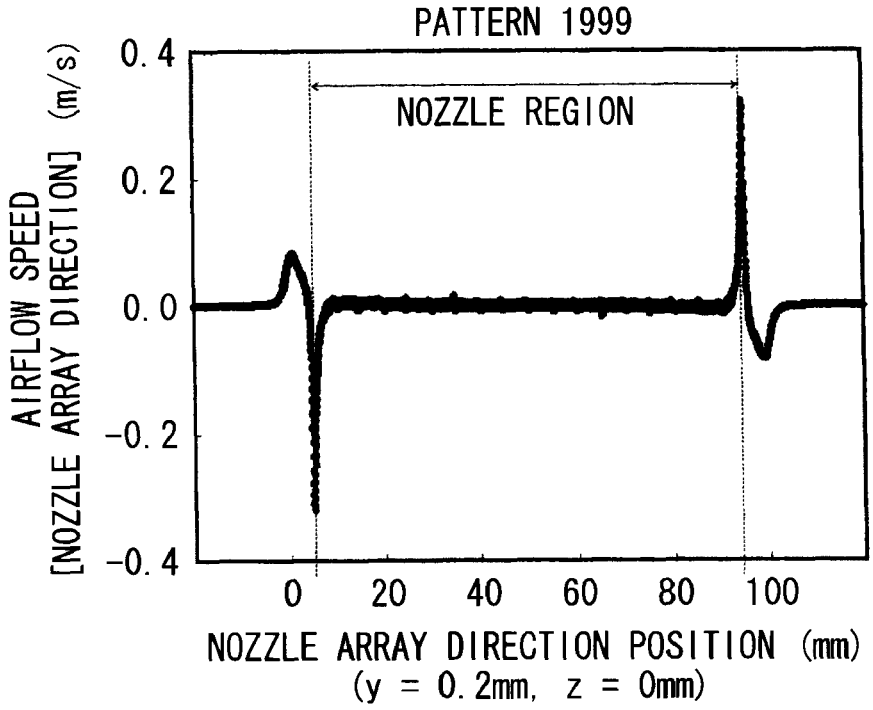
FIG. 18A is a graph showing an example of the relationship between nozzle position in the nozzle array direction and airflow speed in the nozzle array direction when ink drops are ejected in pattern 1999.
Figure 18B:
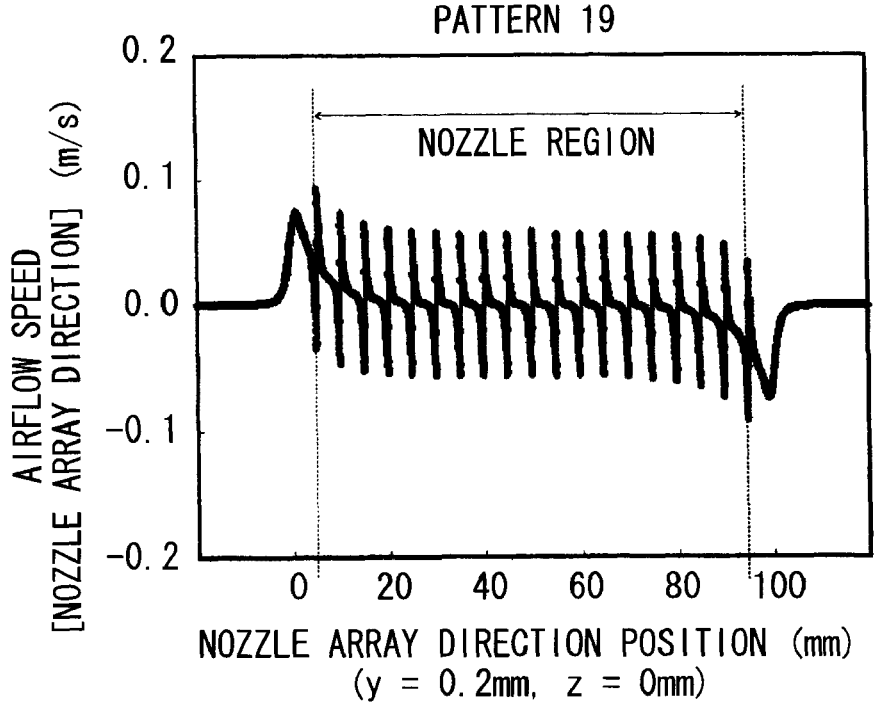
FIG. 18B is the same graph when the ink drops are ejected in pattern 19.

FIG. 18A and FIG. 18B are graphs showing examples of the relationship between nozzle position in the nozzle array direction and airflow speed in the nozzle array direction. FIG. 18A is a graph when ink drops are ejected in pattern 1999, and FIG. 18B is a graph when ink drops are ejected in pattern 19.

In FIG. 18A, in vicinities of the nozzle array both ends, the airflow speeds in the nozzle array direction become faster due to the airflows that go around the outer sides of the nozzle array, whereas at other regions, airflow collides with the ink drop bunch and the airflow speed becomes slower. On the other hand, in FIG. 18B, flows, at which air goes around through the spaces where ink drops are not ejected at the peripheries of the nozzles that eject ink drops, arise. Accordingly, fast airflows in vicinities of the both ends are not generated.

Accordingly, in the second exemplary embodiment, when recording an image having a given width in the nozzle array direction, landing position offset is suppressed by making faster the ejection speeds (initial speeds) of the ink drops that are ejected from the nozzles positioned at the both end regions, among the nozzles that record the image.

Figure 19:
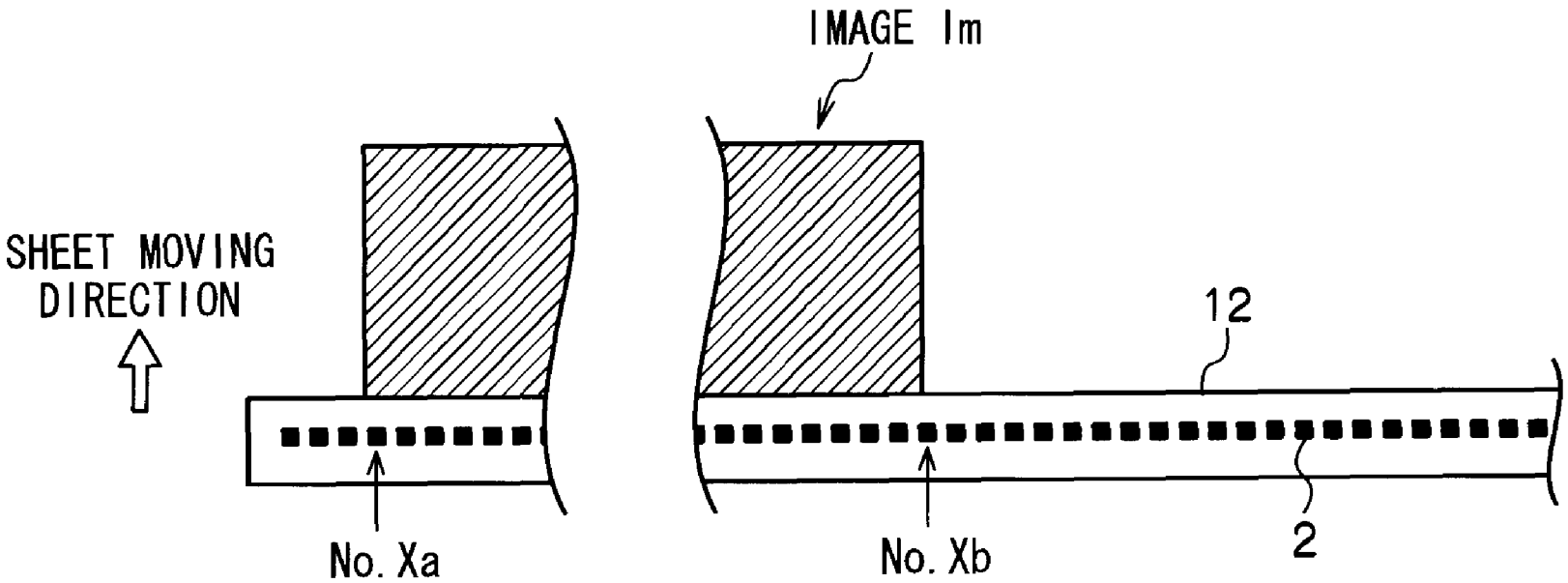
FIG. 19 is a drawing showing an example of the relationship between an image that is recorded and the positions of the nozzles that record the image.

For example, as shown in FIG. 19, when recording an image Im by using plural nozzles that are disposed in succession from No. Xa to No. Xb (Xa<Xb), driving signals are supplied to the driving elements 7 of the respective nozzles such that the initial speed of the ink drops, that are ejected from the nozzles of the both end regions among the plural nozzles, becomes faster than the initial speed of the ink drops that are ejected from nozzles other than the nozzles of the both end regions. (Here, the nozzles of the both end regions are the nozzles that are positioned at position No. Xa and within a predetermined range from the position of No. Xa, and the nozzles that are positioned at position No. Xb and within a predetermined range from the position of No. Xb. Namely, the nozzles of the both end regions are nozzles No. Xa through No. Xa+n, and nozzles No. Xb−n through No. Xb, where n is a predetermined value, and Xa+n<Xb−n.) Note that the "predetermined range" and "initial speed of the ink drops, that are ejected from the nozzles of the both end regions" differ in accordance with conditions such as the sheet conveying speed, the interval at which the respective nozzles are disposed, the density and the size of the image to be recorded, and therefore, are determined in advance by carrying out experimentation or the like. Then, information of the driving signals corresponding thereto is stored in advance.

The positions of the nozzles of the both end regions differ in accordance with the image to be recorded. Accordingly, on the basis of the image data of the image to be recorded, the controller 30 of the liquid droplet ejection device 10 specifies the nozzle positions of the both end regions, and generates selection signals that select driving signals. Concretely, after multi-gradation image data is processed by halftone processing, the controller 30, on the basis of the image data that is obtained by the halftone processing, specifies pixels having gradation values other than "no drop", and judges whether or not an image, in which pixels having gradation values other than "no drop" are to be recorded in succession or spaced apart by one or plural pixels over greater than or equal to a predetermined length in the nozzle array direction, is to be formed. Then, if it is judged that an image, at which a pixel width that is greater than or equal to a predetermined length is to be recorded, is to be formed, the controller 30 specifies the nozzles that record the pixels of the both end regions at the image portion at which the pixel width that is greater than or equal to a predetermined length in the nozzle array direction is to be recorded.

In this way, on the basis of the image data, the controller 30 specifies the positions of the nozzles that eject the ink drops corresponding to the positions of the pixels of the both end regions. For the driving signals of the specified nozzle positions, selection signals are generated such that driving signals corresponding to the pixel density of the aforementioned image portion are selected. For example, as described above, the distances that the ink drops at the both ends are veered off-course differ at pattern 1999 and pattern 999. Accordingly, the controller 30 generates election signals for selecting driving signals such that, the higher the pixel density, the faster the ejection speed of the ink drops of the both end regions. Note that the driving signals for making the initial speeds faster can be generated as described in the first exemplary embodiment.

The second exemplary embodiment can also be applied to a liquid droplet ejection device having a recording head in which the driving elements are structured as heat-generators and that is structured such that the droplet volumes of the ink drops differ per nozzle row as shown in FIG. 11C. In this case, the recording head may be formed by, for example, making the surface areas of the heat-generators corresponding to the end portion nozzles at each nozzle row be larger than those of the heat-generators corresponding to the other nozzles in each nozzle row, so that, regardless of the image to be recorded, the initial speed of the ink drops, that are ejected from the nozzles (end portion nozzles) positioned at the end portions and within predetermined ranges from the end portions in the nozzle array direction at each nozzle row, become faster than the initial speed of the ink drops that are ejected from the nozzles other than the end portions nozzles.

Third Exemplary Embodiment

The second exemplary embodiment describes an example in which the initial speed of the ink drops that are ejected from the nozzles 2 positioned at the both end regions are made to be faster than the initial speed of the ink drops ejected from the nozzles 2 other than the nozzles 2 of the both end regions. The third exemplary embodiment describes a liquid droplet ejection device at which obstructing members that obstruct the flow of air are provided at the outer sides of the array direction both ends of the nozzles that are arrayed at the recording head 12. Note that, other than being provided with the obstructing members, the structure of the liquid droplet ejection device of the third exemplary embodiment is the same as that of the first exemplary embodiment, and therefore, description thereof will be omitted.

Figure 20A:
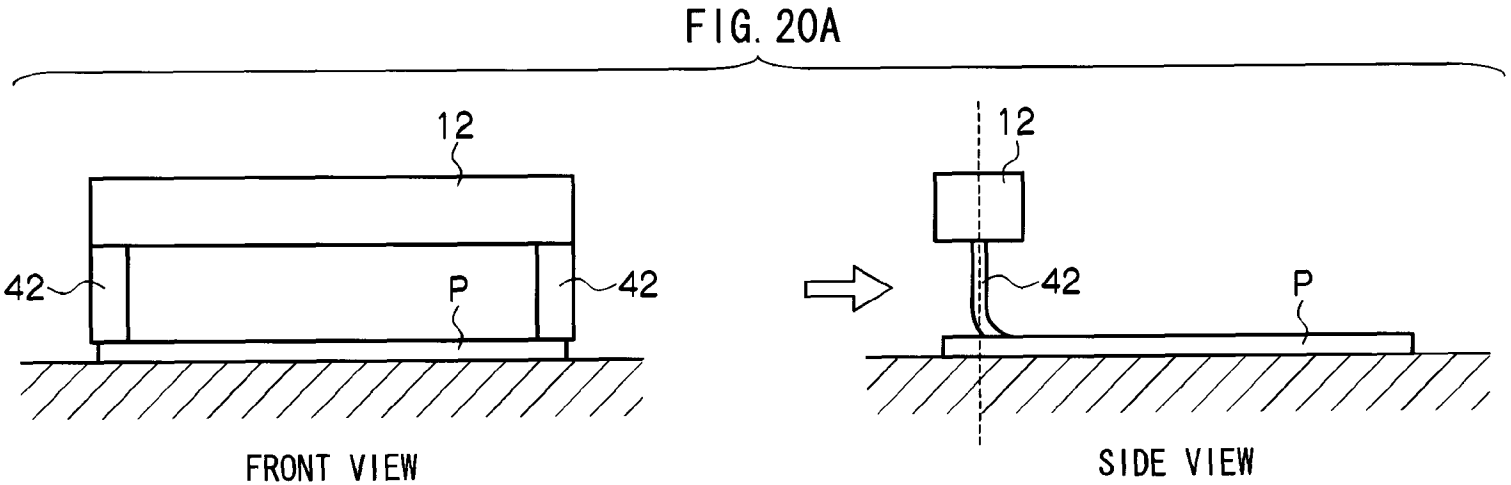
FIG. 20A is a drawing showing each of two obstructing members that are provided at the outer sides of the nozzle array direction both ends of the recording head.

FIG. 20A is a drawing showing each of two obstructing members 42 that are provided at the outer sides of the nozzle array direction both ends of the recording head 12. The obstructing members 42 are formed by elastic members (e.g., rubber, wire or the like), and are structured so as to contact the surface of the conveyer 24 that conveys the sheet P, i.e., the surface of the sheet P, so that the surface of the sheet P, which is where the speed of the airflow is the fastest, also is covered. In this way, in the third exemplary embodiment, the obstructing members 42 are provided so as to contact the nozzle array direction both ends of the recording head 12 and contact the surface of the sheet P that is conveyed (or, in other words, the surface of the conveyer 24). Because there are no gaps between the obstructing members 42 and the sheet P, air is prevented from flowing.

Note that the size of the obstructing members 42 is designed in accordance with the size of the recording head 12 and the device structure.

Figure 20B:
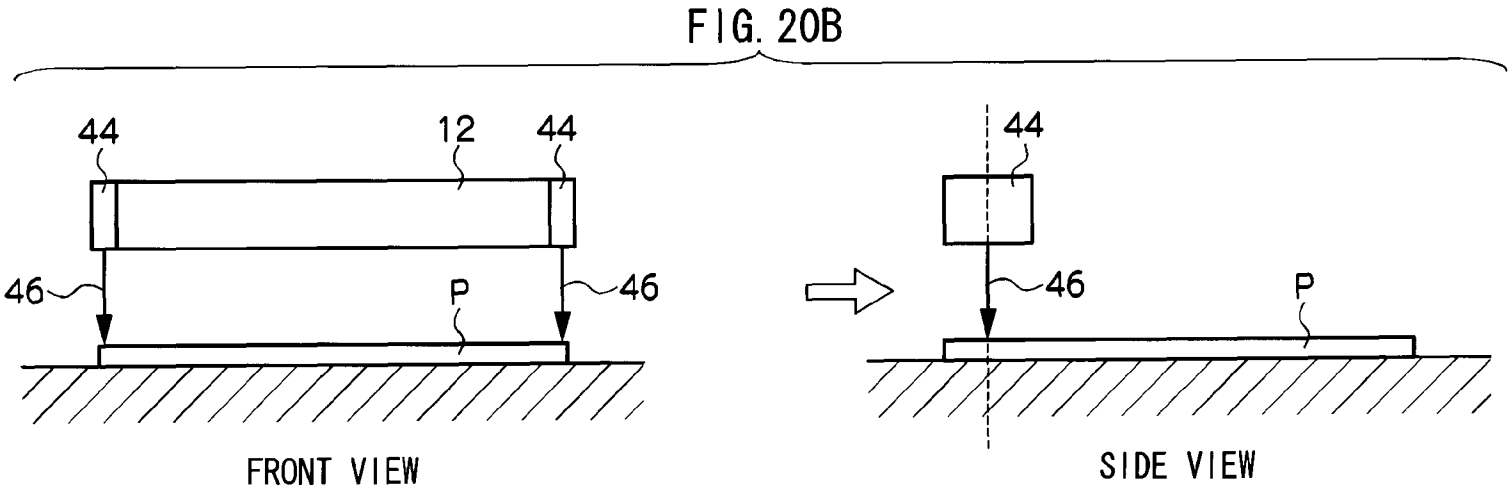
FIG. 20B is a drawing in which obstructing devices, that jet air toward the surface of the sheet P, are provided at the outer sides of the both ends of the recording head.

Further, as a modified example, as shown in FIG. 20B, obstructing devices 44, that jet a gas (here, air) 46 toward the surface of the sheet P and form air curtains, may be provided at the outer sides of the both ends of the recording head 12. By using such obstructing devices 44 as well, airflows of the both end regions in the nozzle array direction of the recording head 12 are obstructed. Note that the air jetting operations of the obstructing devices 44 may be controlled by the controller 30. Further, the amount of the air 46 that is jetted may be made to differ in accordance with the image that is recorded. As described in the second exemplary embodiment, the amount by which the ejected ink drop is veered off-course differs also in accordance with the recording pattern (the pixel density). Accordingly, in the case of an image of a low pixel density at which the ink drops are not veered off-course that much, the amount of air may be reduced, and, the higher the pixel density, the greater the air amount may be made to be.

Other Exemplary Embodiments

Note that the liquid droplet ejection device is not limited to the liquid droplet ejection devices described in the first through third exemplary embodiments, and may be, for example, a liquid droplet ejection device having both the structure described in the first exemplary embodiment in which, the smaller the droplet volume, the faster the initial speed (hereinafter, "the structure of the first exemplary embodiment") and the structure described in the second exemplary embodiment in which the initial speed of the ink drops of the both end regions are made to be faster (hereinafter, "the structure of the second exemplary embodiment"). Further, the liquid droplet ejection device may be a liquid droplet ejection device having both the structure described in the third exemplary embodiment in which the obstructing members 42 or the obstructing devices 44 are provided (hereinafter, "the structure of the third exemplary embodiment") and the structure of the first exemplary embodiment. Moreover, the liquid droplet ejection device may be a liquid droplet ejection device having all of the structure of the first exemplary embodiment, the structure of the second exemplary embodiment and the structure of the third exemplary embodiment.

In the first through third exemplary embodiments, as an example, there is described a liquid droplet ejection device that has the recording head 12 having a length substantially corresponding to the width of the sheet P, and that records an image on the sheet P by ejecting ink drops from the nozzles 2 while conveying the sheet P at a uniform speed while the recording head 12 remains fixed. However, the exemplary embodiments are not limited to the above-described liquid droplet ejection device provided that it is a liquid droplet ejection device of a structure in which a recording head and a medium to be recorded move relatively. The structure of at least one of the above-described first through third exemplary embodiments may be applied to, for example, a liquid droplet ejection device such as shown in FIG. 21.

Figure 21:
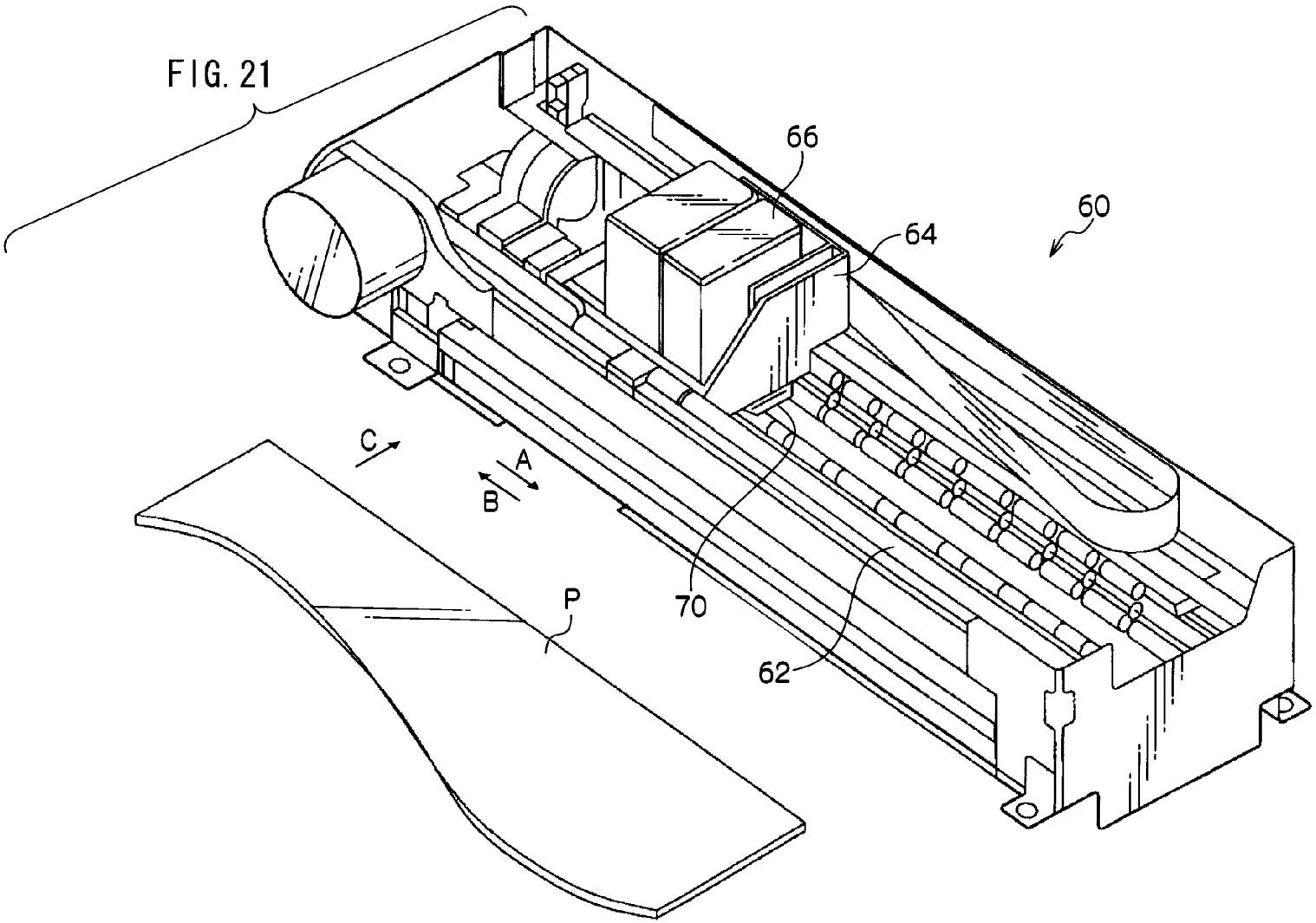
FIG. 21 is a drawing showing another example of the liquid droplet ejection device.

In a liquid droplet ejection device 60 shown in FIG. 21, an ink cartridge 66 is installed in a carriage 64 that moves along a guide shaft 62. Plural nozzles are arrayed along a sheet conveying direction C at a recording head 70 that is provided integrally with the distal end of the ink cartridge 66. An image is recorded on the sheet P by ink drops being ejected from the nozzles onto the sheet P that serves as a recording medium.

In the liquid droplet ejection device 60, due to the carriage 64 moving in the A direction (the forward travel path) in FIG. 21, ink drops are ejected from the nozzles of the recording head 70, and an image is recorded on the sheet width. Next, the sheet P is conveyed in the C direction by an amount corresponding to the width of the recorded image, the carriage 64 is this time moved in the B direction (the return travel path), and an image is recorded in the same way at the recording region that is adjacent in the C direction. These operations are repeated, and an image is formed on the sheet P. Note that one-way recording may be carried out in which image recording is carried out only on the forward travel path, and, on the return travel path, the carriage is merely returned without ejecting ink drops.

As described in the exemplary embodiments, piezo elements or heat-generating elements may be used as the driving elements that are provided at the respective nozzles of the recording head 70 of the liquid droplet ejection device 60 shown in FIG. 21.

What is claimed is:

1. A liquid droplet ejection device comprising:

a recording section at which a plurality of liquid droplet ejectors are arrayed, each liquid droplet ejector having a driving element, and ejecting a liquid droplet onto a recording medium due to a driving signal for ejecting a liquid droplet being supplied to the driving element;

a moving section that moves the recording section and the recording medium relative to one another in a direction intersecting an array direction in which the plurality of liquid droplet ejectors are arrayed; and a driving signal supplying section that, when a plurality of types of liquid droplets having different droplet volumes are ejected onto the recording medium while the recording section and the recording medium are moved relatively, generates the driving signals such that, the smaller a droplet volume of a liquid droplet, the faster the ejection speed of the liquid droplet, and supplies the driving signals to the driving elements, wherein, when recording on the recording medium an image having a width that is greater than or equal to a predetermined length in the array direction, the driving signal supplying section generates and supplies the driving signals such that an ejection speed of liquid droplets that are ejected from end portion liquid droplet ejectors, which are positioned at both ends in the array direction and within predetermined ranges from the respective both ends of the liquid droplet ejectors that are used for recording the image, is faster than an ejection speed of liquid droplets that are ejected from liquid droplet ejectors other than the end portion liquid droplet ejectors.

2. The liquid droplet ejection device of claim 1, wherein the driving signal supplying section selects the end portion liquid droplet ejectors on the basis of image data of the image.

3. The liquid droplet ejection device of claim 1 further comprising, at outer sides of both ends in the array direction of the liquid droplet ejectors, obstructing members that obstruct flows of air that arise due to relative movement between the recording section and the recording medium.

4. The liquid droplet ejection device of claim 3, wherein respective first ends of the obstructing members contact the recording section and respective second ends of the obstructing members contact the recording medium, and the obstructing members comprise elastic members.

5. The liquid droplet ejection device of claim 3, wherein the obstructing members expel a gas from a recording section side toward a surface of the recording medium.

6. The liquid droplet ejection device of claim 5, wherein the obstructing members expel different amounts of the gas in accordance with an image that is recorded by the recording section.

7. A liquid droplet ejection device comprising:

a recording section at which a plurality of liquid droplet ejectors that eject liquid droplets onto a recording medium are arrayed, a plurality of rows of the liquid droplet ejectors are provided in a direction intersecting an array direction in which the liquid droplet ejectors are arrayed, a droplet volume of liquid droplets differing between each of the rows, and the smaller the droplet volume of liquid droplets that are ejected at a row of the liquid droplet ejectors, the faster the ejection speed of the liquid droplets that are ejected at the row of the liquid droplet ejectors; and a moving section moving the recording section and the recording medium relative to one another in a direction intersecting the array direction of the liquid droplet ejectors, wherein an ejection speed of liquid droplets that are ejected from end portion liquid droplet ejectors, which are positioned at both ends in the array direction and within predetermined ranges from the respective both ends of each row of the liquid droplet ejectors, is faster than an ejection speed of liquid droplets that are ejected from liquid droplet ejectors other than the end portion liquid droplet ejectors at the end of each row.

8. The liquid droplet ejection device of claim 7, further comprising, at outer sides of both ends in the array direction of the liquid droplet ejectors, obstructing members that obstruct flows of air that arise due to relative movement between the recording section and the recording medium.

9. The liquid droplet ejection device of claim 8, wherein respective first ends of the obstructing members contact the recording section and respective second ends of the obstructing members contact the recording medium, and the obstructing members comprise elastic members.

10. The liquid droplet ejection device of claim 8, wherein the obstructing members expel a gas from a recording section side toward a surface of the recording medium.

11. The liquid droplet ejection device of claim 10, wherein the obstructing members expel different amounts of the gas in accordance with an image that is recorded by the recording section.

* * * * *